US006746390B2

(12) United States Patent
Tamura et al.

(10) Patent No.: US 6,746,390 B2
(45) Date of Patent: Jun. 8, 2004

(54) SHEET FINISHING METHOD, SHEET FINISHER AND IMAGE FORMING APPARATUS FOR USE THEREWITH

(75) Inventors: Hitoshi Tamura, Hachioji (JP); Kohji Yoshie, Hachioji (JP); Hiroto Ito, Hachioji (JP); Masato Hattori, Hachioji (JP); Hirohiko Okabe, Tokorozawa (JP); Hirotaka Kataoka, Kawaguchi (JP)

(73) Assignee: Konica Corporation (JP)

( * ) Notice: Subject to any disclaimer, the term of this patent is extended or adjusted under 35 U.S.C. 154(b) by 0 days.

(21) Appl. No.: 10/217,321

(22) Filed: Aug. 12, 2002

(65) Prior Publication Data

US 2003/0040414 A1 Feb. 27, 2003

(30) Foreign Application Priority Data

Aug. 21, 2001 (JP) ..... 2001-250246

(51) Int. Cl.[7] ..... B31F 1/10

(52) U.S. Cl. ..... 493/445; 493/23; 493/25; 493/405; 493/416; 493/417; 493/442; 493/444; 493/434; 270/58.09

(58) Field of Search ..... 493/405, 416, 493/417, 442, 444, 445, 454, 434, 3, 8, 10, 28, 23, 25; 270/58.07, 58.09

(56) References Cited

U.S. PATENT DOCUMENTS

| | | | | | |
|---|---|---|---|---|---|
| 5,169,376 | A | * | 12/1992 | Ries et al. | 493/445 |
| 5,738,620 | A | * | 4/1998 | Ebner et al. | 493/445 |
| 5,993,369 | A | * | 11/1999 | Sekita et al. | 493/420 |
| 6,004,254 | A | * | 12/1999 | Murata | 493/444 |
| 6,022,011 | A | * | 2/2000 | Hirose | 270/37 |
| 6,276,677 | B1 | * | 8/2001 | Hommochi et al. | 270/32 |

* cited by examiner

*Primary Examiner*—Eugene Kim
*Assistant Examiner*—Christopher R Harmon
(74) *Attorney, Agent, or Firm*—Muserlain, Lucas & Mercanti

(57) ABSTRACT

A sheet finishing method in which a sheet delivered from an image forming apparatus main body is conveyed and stacked on a sheet placement table, and the stacked sheets are positioned and aligned, and then folded by a folding means composed of a paired folding rollers and a folding plate. The sheet finishing method is controlled such that a rotation motion of the paired folding rollers is switched between a state to be rotated along with an advancing motion of the folding plate and a state to be stopped in accordance with the number of sheets stacked on the sheet placement table.

4 Claims, 18 Drawing Sheets

FIG. 10 ( a )
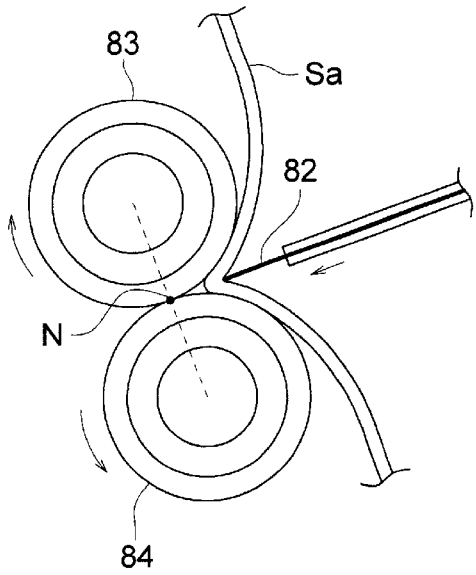
FIG. 10 ( b )
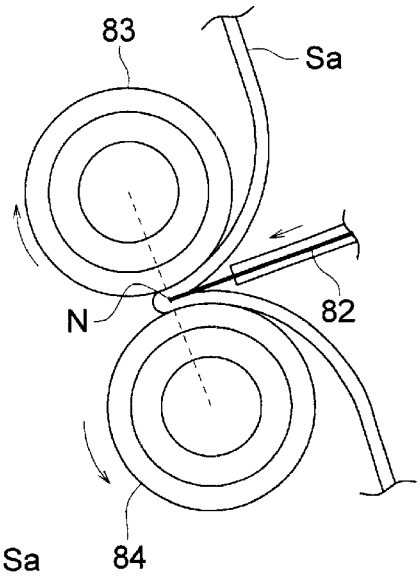
FIG. 10 ( c )
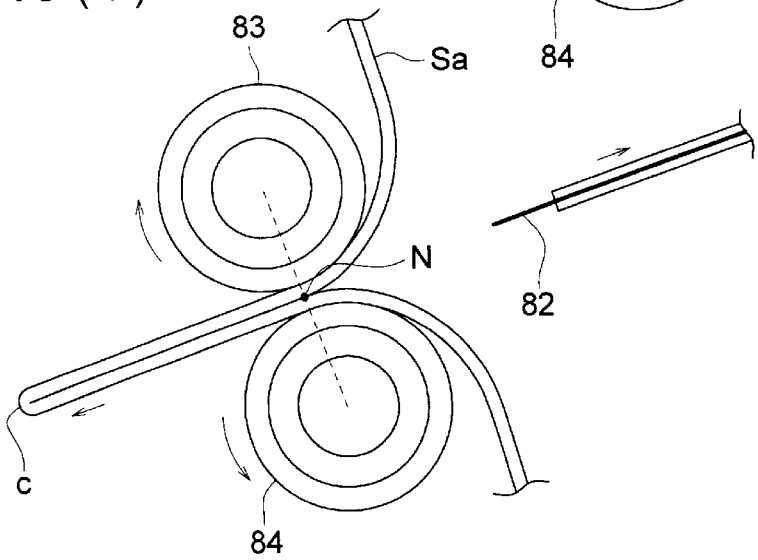

FIG. 12 ( a )
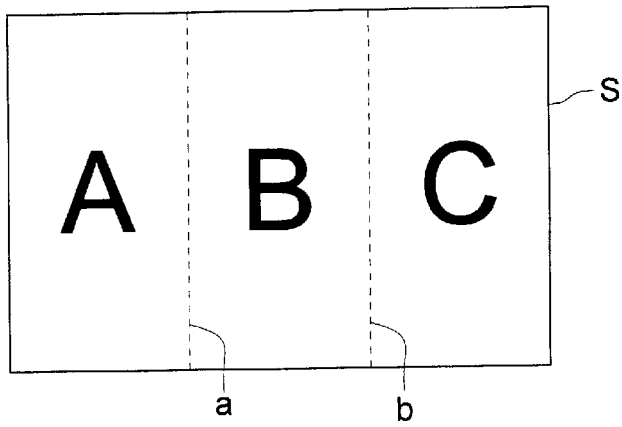
FIG. 12 ( b )
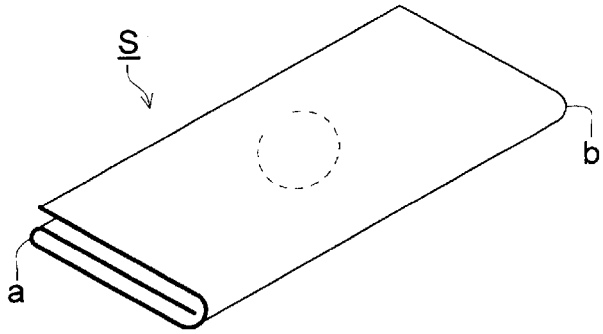
FIG. 12 ( c )
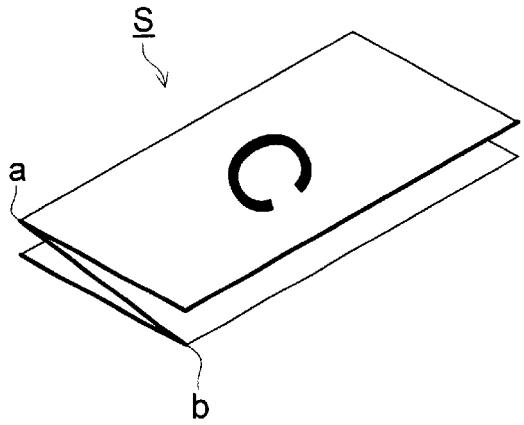

FIG. 13 ( a )
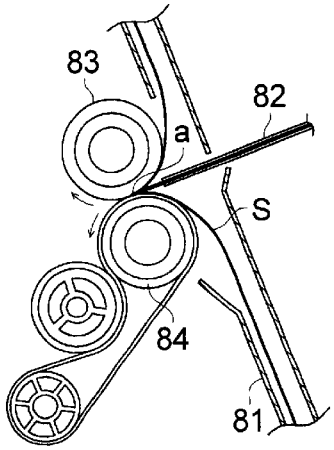
FIG. 13 ( b )
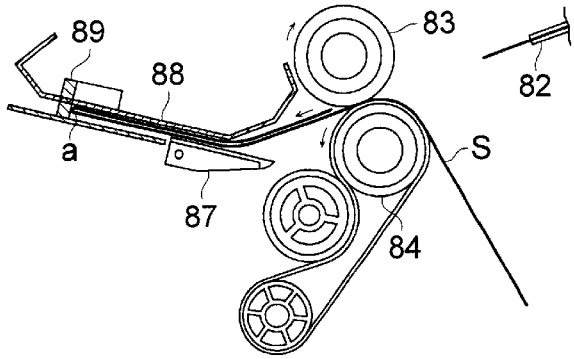
FIG. 13 ( c )
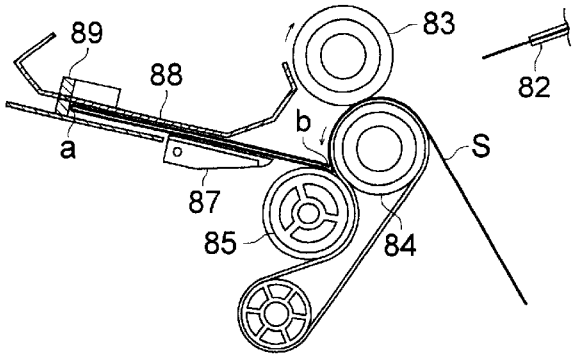
FIG. 13 ( d )
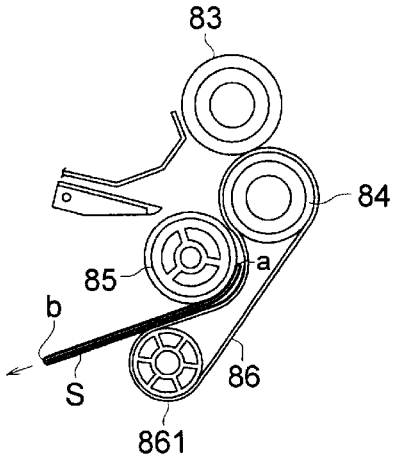

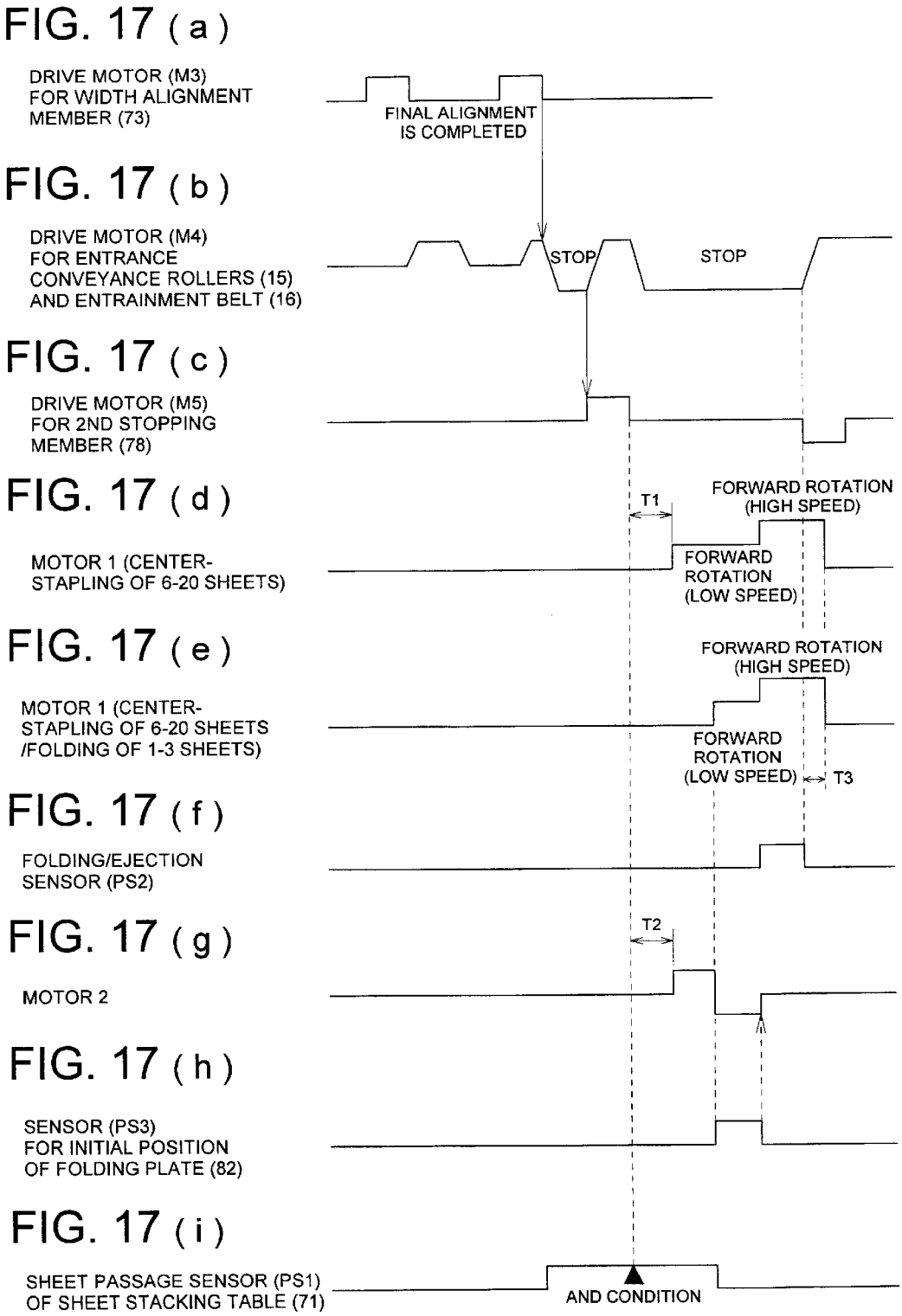
FIG. 17 (a)
DRIVE MOTOR (M3) FOR WIDTH ALIGNMENT MEMBER (73)
FINAL ALIGNMENT IS COMPLETED
FIG. 17 (b)
DRIVE MOTOR (M4) FOR ENTRANCE CONVEYANCE ROLLERS (15) AND ENTRAINMENT BELT (16)
STOP
STOP
FIG. 17 (c)
DRIVE MOTOR (M5) FOR 2ND STOPPING MEMBER (78)
FIG. 17 (d)
T1
FORWARD ROTATION (HIGH SPEED)
MOTOR 1 (CENTER-STAPLING OF 6-20 SHEETS)
FORWARD ROTATION (LOW SPEED)
FIG. 17 (e)
FORWARD ROTATION (HIGH SPEED)
MOTOR 1 (CENTER-STAPLING OF 6-20 SHEETS /FOLDING OF 1-3 SHEETS)
FORWARD ROTATION (LOW SPEED)
T3
FIG. 17 (f)
FOLDING/EJECTION SENSOR (PS2)
FIG. 17 (g)
T2
MOTOR 2
FIG. 17 (h)
SENSOR (PS3) FOR INITIAL POSITION OF FOLDING PLATE (82)
FIG. 17 (i)
SHEET PASSAGE SENSOR (PS1) OF SHEET STACKING TABLE (71)
AND CONDITION

SHEET FINISHING METHOD, SHEET FINISHER AND IMAGE FORMING APPARATUS FOR USE THEREWITH

BACKGROUND OF THE INVENTION

The present invention relates to a sheet finisher provided with a function by which a sheet delivered from an image forming apparatus such as an electrophotographic copier, printer, facsimile device and a hybrid machine having these many functions is received, stacked in a sheet accommodation section and a finishing such as a folding processing is conducted, and delivered onto a sheet delivery section.

There is provided a sheet finisher by which many number of sheets on which images are recorded by an image forming apparatus main body such as a copier, printer, facsimile device or hybrid machine of these devices are collated for each number of printed volumes, stapled by a stapler and bookbound. This sheet finisher is connected to a print function of the image forming apparatus main body and driven.

As a sheet finisher to conduct the staple processing on a sheet bundle which is a set formed of a plurality of sheets, Japanese Patent Publication Tokkaihei No. 2-276691, 8-319054, or Japanese Patent Publication Tokkohei No. 5-41991 are disclosed.

As the sheet finisher by which a central portion of the sheet bundle is center-stapled, and center-folded at the center-stapled portion and a simple bookbinding is conducted, a sheet finisher written in Japanese Patent Publication Tokkaihei NO. 10-181990 is well known.

This sheet finisher is provided with, for the center-stapling and center-fold processing of the sheet bundle, a center-fold processing section composed of a pair of center-folding rollers which are rotated in pressure-contact with each other, and a center-folding plate to push the center-stapled portion of the sheet bundle in the nip position of the center-folding rollers.

In the sheet finisher to conduct the center-fold processing, there are following problems.

FIG. 18 is a sectional view of the conventional center-fold processing section. The center-fold processing section is structured by a pair of folding rollers composed of an upper roller 83A and lower roller 84A, and a folding plate 82A.

In the center-fold processing section, the center-stapling and center-fold processing, center-fold processing of a small number of sheets, and three-fold processing of a small number of sheets are conducted.

In the case where the center-fold processing is conducted without conducting the staple processing on the small number of sheets, when, while the upper roller 83A and lower roller 84A are rotated, the folding plate 82A is pushed in a nip portion N of the folding roller pair, the sheet S1 in contact with the outer peripheral surface of the upper roller 83A and lower roller 84A reaches the nip position N earlier and is folded, and in a folded portion between it and the sheet S2 in contact with the sheet S1, the slippage between sheets as shown in the drawing, is generated. Particularly, when the advancing speed of the folding plate 82A is lower than the peripheral velocity of the outer peripheral surface of the upper roller 83A and lower roller 84A, the slippage between sheets is conspicuous.

When the advancing speed of the folding plate 82A is made higher than the peripheral velocity of the outer peripheral surface of the upper roller 83A and lower roller 84A, the sheets S1 and S2 which are pushed in by the folding plate 82A are forcibly pushed in the nip position N, and there is a case where a breakage is generated in the sheet bundle.

SUMMARY OF THE INVENTION

The object of the present invention is to solve the above problems and to provide a sheet finisher for use with an image forming apparatus by which a good folding processing can be conducted on the sheet bundle.

The above object can be solved by the following sheet finishing method, sheet finisher, and image forming apparatus.

(1) A sheet finishing method in which a sheet delivered from an image forming apparatus main body is conveyed and stacked on a sheet placement table, and the stacked sheets are positioned and aligned, and then folded by a folding means composed of a paired folding rollers and a folding plate, the sheet finishing method is characterized in that it is controlled such that a rotation motion of the paired folding rollers is switched between a state to be rotated along with an advancing motion of the folding plate and a state to be stopped in accordance with the number of sheets stacked on the sheet placement table.

(2) A sheet finisher in which a sheet delivered from an image forming apparatus main body is conveyed and stacked on a sheet placement table, and the stacked sheets are positioned and aligned, and folded by a folding means composed of a paired folding rollers and a folding plate, the sheet finisher is characterized in that it has a detection means for detecting the number of sheets, the first drive means for rotating the paired folding rollers, the second drive means for making the folding plate to advance and retreat, and a control means for controlling the drive of the first drive means and the second drive means, and it is controlled such that a rotation motion of the paired folding rollers is switched between a state to be rotated along with an advancing motion of the folding plate and a state to be stopped in accordance with the number of sheets detected by the detection means.

(3) An image forming apparatus which is characterized in that it is provided with an image forming apparatus main body composed of an image writing means, image forming means, and sheet conveying means and the sheet finisher described in (2).

BRIEF DESCRIPTION OF THE DRAWINGS

FIGS. 10(*a*)–10(*c*) are sectional views showing a process of a two-fold processing by a fold processing section.

FIG. 12(*a*) is a developed plan view to be tree-fold processed sheet, FIG. 12(*b*) is a perspective view of the three-fold processed sheet, and FIG. 12(*c*) is a perspective view of the three-fold processed sheet into Z-shape.

FIGS. 13(*a*)–13(*d*) are sectional views showing the three-fold processing process.

FIGS. 17(*a*)–17(*i*) are timing charts showing the control of the fold processing.

DETAILED DESCRIPTION OF THE PREFERRED INVENTION

Figure 1:
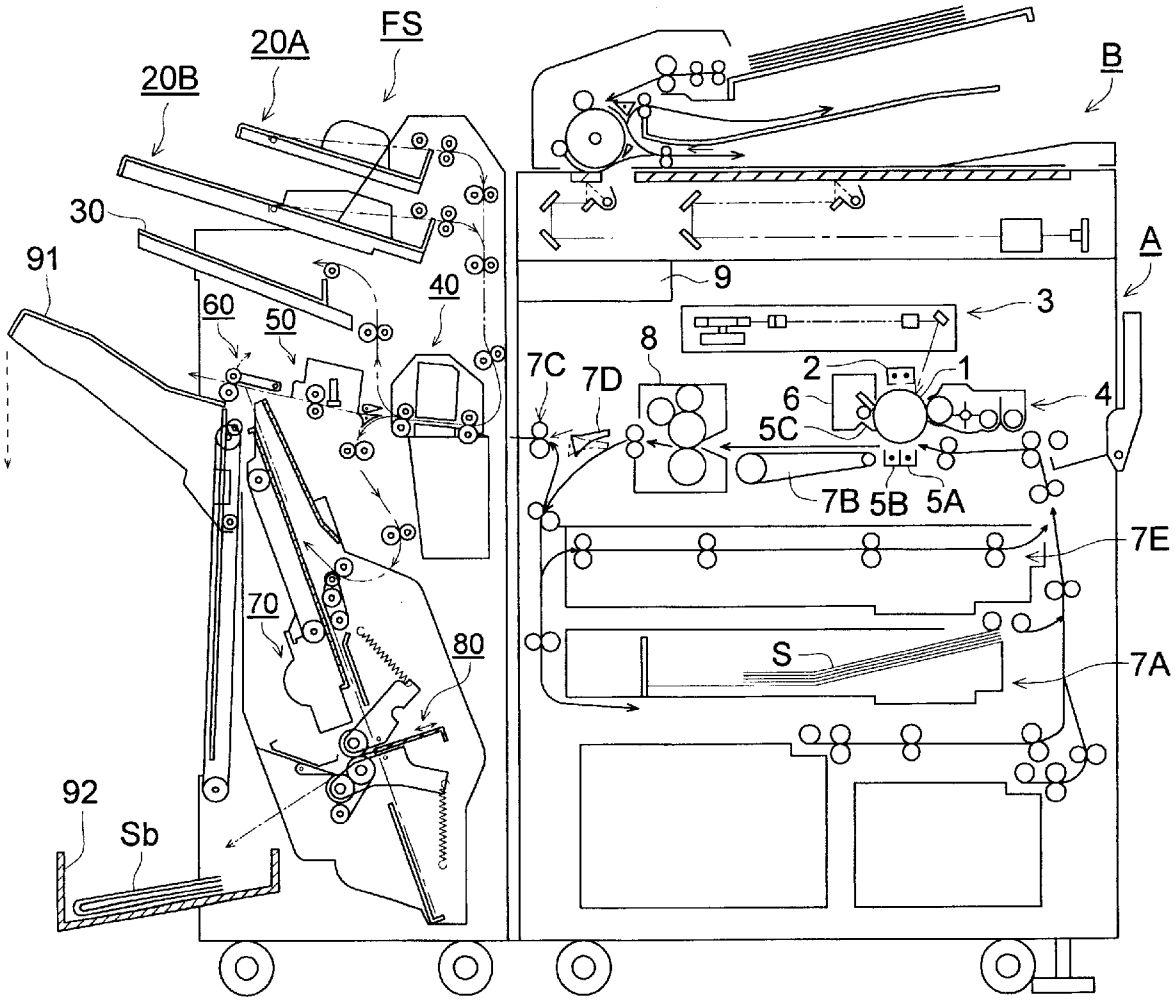
FIG. 1 is an overall structural view of an image forming system structured by an image forming apparatus main body, image reading apparatus, and finisher.

Next, referring to the drawing, a sheet finisher of the present invention and an image forming apparatus equipped with the sheet finisher will be described.

An Embodiment of the Image Forming Apparatus

FIG. 1 is a overall structural view of an image forming system composed of an image forming apparatus main body A, image reading apparatus B, and sheet finisher (hereinafter, called finisher) FS.

The forming apparatus main body A has an image forming section in which a charging means 2, image exposure means (writing means) 3, developing means 4, transfer means 5A, discharging means 5B, separation claw 5C, and cleaning means 6 are arranged around a rotating image carrier (hereinafter, called photoreceptor) 1, and after uniform charging is conducted on the surface of the photoreceptor 1 by the charging means 2, an exposure scanning according to the image data read from the document is conducted by the laser beam of the image exposure means 3, and a latent image is formed, and the latent image is reversal developed by the developing means 4, and a toner image is formed on the surface of the photoreceptor 1.

On the one hand, a sheet S fed from a sheet accommodation means 7A is sent to a transfer position. In the transfer position, the toner image is transferred onto the sheet S by the transfer means 5A. After that, electric charges of the rear surface of the sheet S is eliminated by the discharging means 5B, separated from the photoreceptor 1 by the separation claw 5C, conveyed by an intermediate conveying section 7B, succeedingly, heating fixed by the fixing means 8, and delivered from a sheet delivery section 7C.

When the image formation is conducted on double sides of the sheet S, the sheet S which is heating fixed by the fixing means 8, is branched from a normal sheet delivery path by a conveying path switching plate 7D, and after it is switched back and front and rear surfaces are reversed in the reversal conveying 7E, it is delivered to the outside of the apparatus by the sheet delivery section 7C. The sheet S delivered from the sheet delivery section 7C, is sent to the finisher FS.

On the one hand, on the surface after the image processing of the photoreceptor 1, the developing agent remained on the surface is removed by the cleaning means 6 in the downstream of the separation claw 5C, and the photoreceptor 1 stands by the next image formation.

On the front surface side of the upper portion of the image forming apparatus main body A, an operation section 9 to select and set an image formation mode and sheet finishing mode is arranged.

On the upper portion of the image forming apparatus main body A, there is arranged an image reading apparatus B equipped with an automatic document feeding apparatus of a document movement type reading-out system.

Sheet Finishing Apparatus

Figure 2:
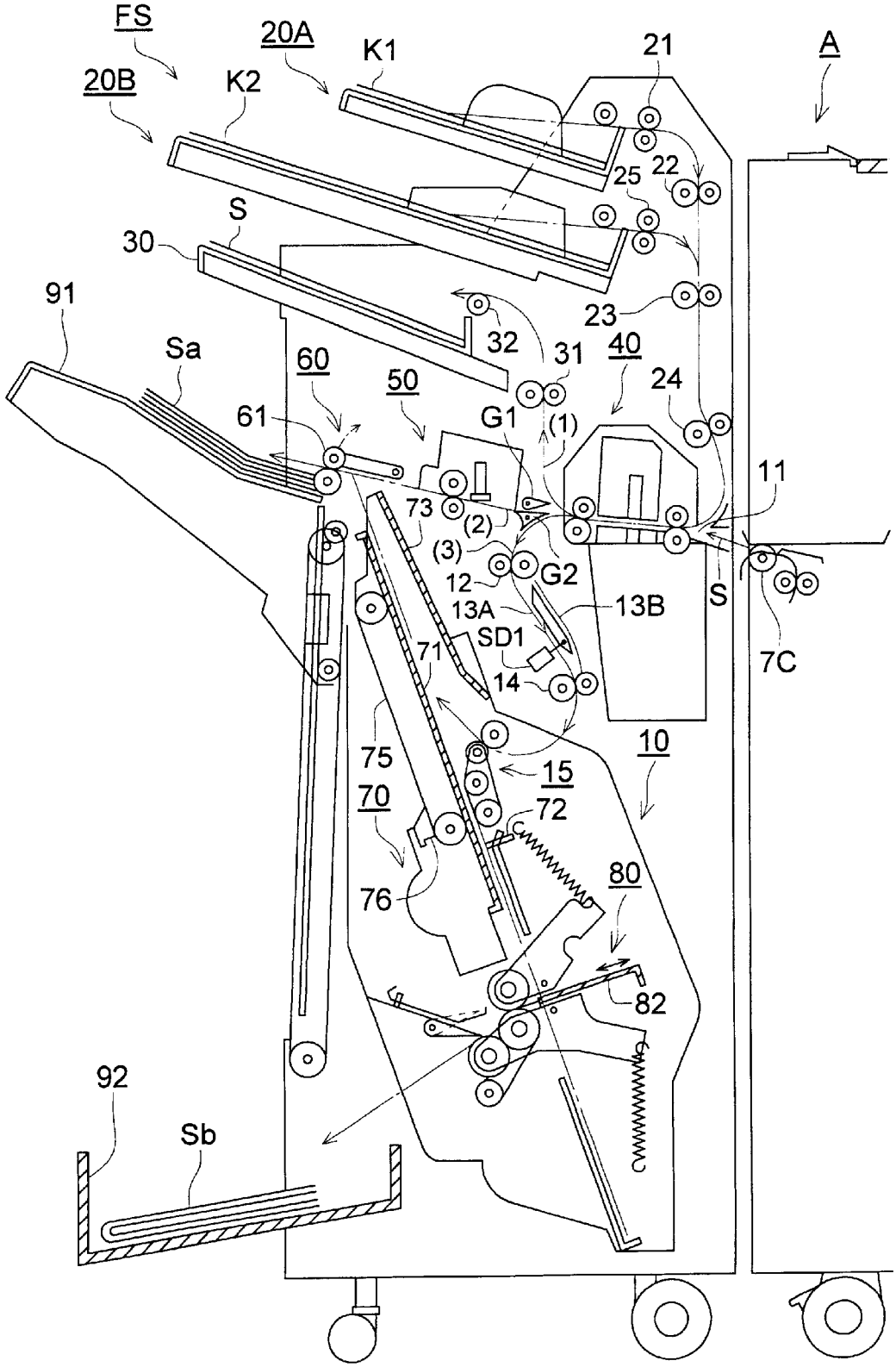
FIG. 2 is an overall structural view showing a conveying path of a sheet in the finisher according to the present invention.

FIG. 2 is an overall structural view showing a conveying path of the sheet S in the sheet finisher FS according to the present invention.

In the finisher FS, on the upper stage in the drawing, the first sheet feeding means 20A and the second sheet feeding means 20B and fixed sheet delivery table 30 are arranged, and on the middle stage, a punching means 40, shift means 50 and sheet delivery means 60 are serially arranged on the almost horizontal same plane, and on the lower stage, a staple processing section 70 and fold processing section 80 are serially arranged on the slanting same plane.

Further, on the left side surface in the drawing of the finisher FS, there are arranged an elevation sheet delivery table 91 on which a shift processed sheet S and end staple processed sheet bundle Sa are stacked, and a fixed sheet delivery table 92 on which three-folding or two-folding processed sheet bundle Sb is stacked.

The position and height of the finisher FS are adjusted in such a manner that a receiving section 11 of the sheet S conveyed from the image forming apparatus main body A coincides with the sheet delivery section 7C of the image forming apparatus main body A, and the finisher FS is arranged.

The sheet S which is image forming processed, supplied from the image forming apparatus main body A, an interleaf K1 which partitions between sheet bundles supplied from the first sheet feeding means 20A, and a cover sheet K2 supplied from the second sheet feeding means 20B are introduced into the receiving section 11.

Sheet Feeding Means

The interleaf K1 accommodated in the sheet feeding tray of the first sheet feeding means 20A is separated and fed by a sheet feeding section 21, nipped by conveying rollers 22, 23, 24, and introduced into the receiving section 11. Further, the cover sheet K2 accommodated in the sheet feeding tray of the second sheet feeding means 20B is separated and fed by the sheet feeding section 25, nipped by the conveying rollers 23 and 24, and introduced into receiving section 11.

Sheet Branching Means

A sheet branching means composed of switching means G1 and G2 is provided on the downstream side in the sheet conveying direction of the punching means 40. The switching means G1 and G2 are selectively branched to any one of three sheet conveying paths, that is, the first conveying path (1) for the upper stage sheet delivery, the second conveying path (2) for the middle stage, and the third conveying path (3) for the lower stage, by the drive of a solenoid which is not shown.

Simple Sheet Delivery

When this sheet conveying is set, the switching means G1 shuts off the second conveying path (2), and the third conveying path (3), and only the first conveying path (1) is opened.

The sheet S which passes the first conveying path (1) is nipped by the conveying roller 31 and elevated, delivered by the delivery roller 32, placed on the fixed sheet delivery table 30, and succeedingly stacked.

On the fixed sheet delivery table 30, maximum about 200 sheets S can be stacked.

Shift Processing

When the sequence is set to this conveying mode, the switching means G1 is withdrawn upward, the switching means G2 shuts off the third conveying path (3) and opens the second conveying path (2), thereby, the pass of the sheet S is made possible. The sheet S passes the sheet path formed between the switching means G1 and G2.

The sheet S which is delivered from the image forming apparatus main body A and on which the image is formed, or the interleaf K1 fed from the first sheet feed means 20A, or the cover sheet K2 fed from the second sheet feed means 20B, passes the intermediate sheet path of the switching means G1 and G2, and by the shifting means 50, it is shifting processed so that a predetermined amount is moved in the direction perpendicular to the sheet conveying direction, and conveyed in the sheet delivery direction.

The shifting means 50 conducts the shift processing by which the sheet delivery position of the sheet S is changed in the conveying width direction for each predetermined number of sheets. The shift processed sheet S is delivered on the elevation sheet delivery table 91 outside the apparatus by the sheet delivery means 60 and succeedingly stacked. This elevation sheet delivery table 91 is structured in such a manner that, when many number of sheets S are delivered, it is succeedingly lowered, and can accommodate sheets S of maximum about 3000 sheets (A4, B5).

Staple Processing

Figure 3:
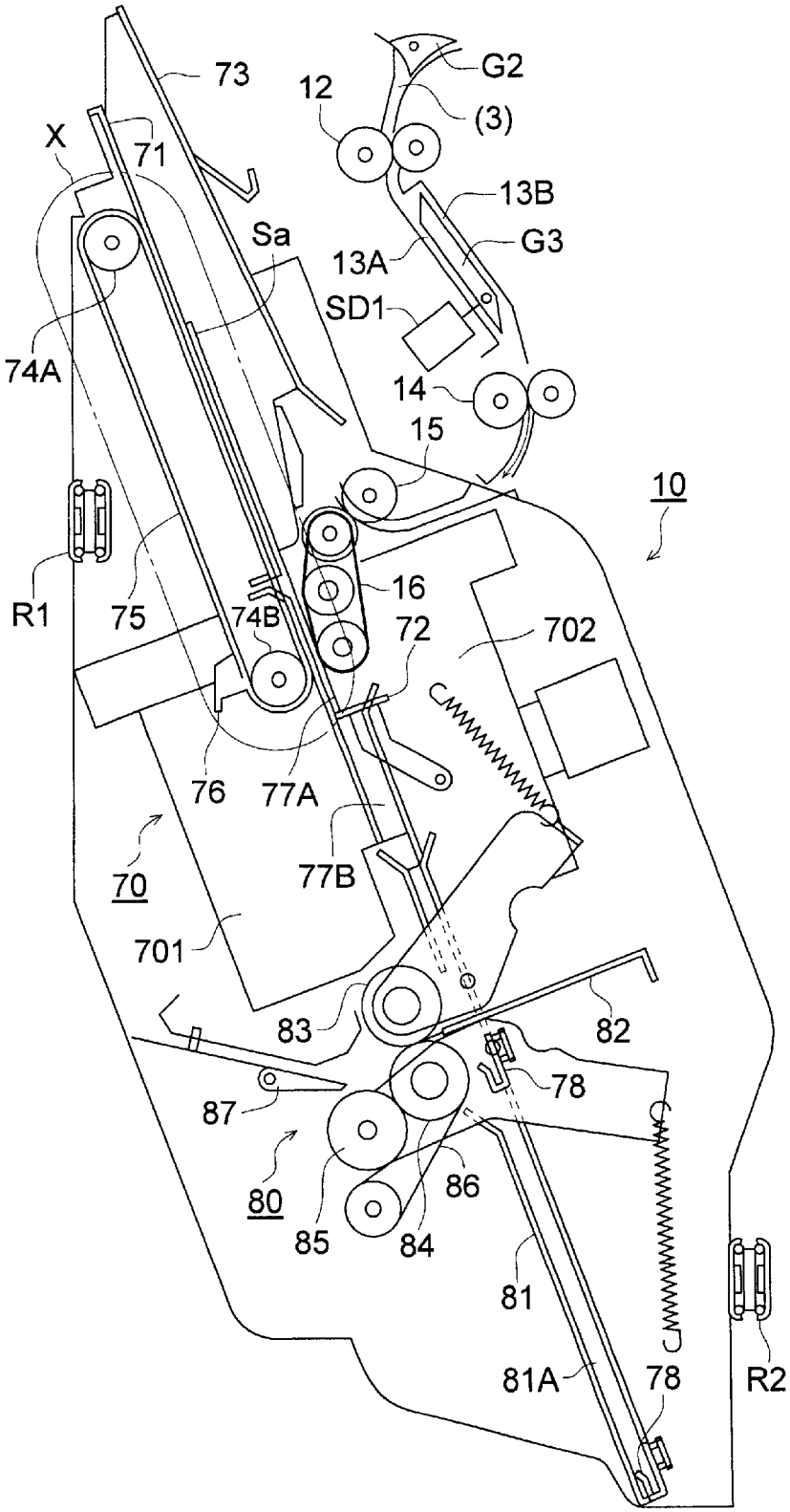
FIG. 3 is a sectional view of the finishing unit composed of a stapling section and fold processing section.

FIG. 3 is a sectional view of a finisher unit 10 composed of a staple processing section 70 and fold processing section 80.

In the operation section 9, when the staple processing (refer to FIGS. 4(*a*)–4(*d*)) or fold processing is set, the image formed sheet S which is image forming processed in the image forming apparatus main body A and sent into the receiving section 11 of the finisher FS, passes a punching means 40 (refer to FIG. 2), and is sent into the third conveying path (2) below the switching means G2, held by the conveying roller 12, and conveyed downward.

In the third conveying path (3), when the sheet S whose size is larger than A4, or B5 size, is conveyed, the solenoid SD1 is driven and the sheet S passes the path 13A on the left side in the drawing of the switching means G3 and held by the conveying roller 14, and conveyed downward. The sheet S is nipped by inlet conveying roller pair 15 located further downstream and sent out, delivered to the upper space of the sheet placement table 71 slantingly arranged, and comes into contact with the sheet placement table 71 or the upper surface of the sheet S which is stacked on the sheet placement table 71, and conveyed to the obliquely upward portion. After the trailing edge portion in the advancing direction of the sheet S is delivered from the holding position of the conveying roller 14, it turns to the lowering by the self weight of the sheet S, conveyed on the slant surface of the sheet placement table 71, and trailing edge of the sheet S comes into contact with the sheet contact surface of the sheet trailing edge contact member (hereinafter, called also the first contact member) 72 for the end-stapling in the vicinity of the staple means composed of a staple-pin striking mechanism 701 and a staple-pin receiving mechanism 702, and is stopped. Numeral 16 is a rotating endless belt-like sheet guiding member (hereinafter, called a winding-in belt), which slide-contacts with the leading edge portion of the sheet S and winds-in it and sends to the first contact member 72. In this connection, the sheet guiding member 16 may also be a rotatable vane wheel.

In the third conveying path (3), in order to effectively and continuously convey the small sized sheet S such as A4 or B5, and increase the copy productivity, a movable switching means G3 and a sheet path 13B parallel to the sheet path 13A on the left side in the drawing of the switching means G3 are provided.

When the solenoid SD1 connected to the switching means G3 is driven, the sheet path 13A is shut off, and the sheet path 13B is opened.

The leading edge portion of the small sized sheet S of the first sheet sent from the conveying roller 12 passes the sheet path 13B, and is brought into contact with the peripheral surface of the inlet conveying roller pair which are in the rotation stop condition, and stopped.

Next, the electric power of the solenoid SD1 is turned off, the leading edge portion of the switching means G3 is moved clockwise and shuts off the sheet path 13B, and opens the sheet path 13A. The leading edge portion of the second sheet S sent from the conveying roller 12 passes the sheet path 13A and is brought into contact with the peripheral surface of the inlet conveying roller pair 15 in the rotation stop condition and stopped. Accordingly, in the vicinity of the nip position of the inlet conveying roller pair 15, each of leading edge portions of the first sheet S and the second sheet S is overlapped with each other and stopped, and on standby the next operation.

In the predetermined timing, the inlet conveying roller pair 15 is rotated, and two sheets S are held and simultaneously conveyed and delivered onto a sheet placement table 71. After the third sheet, the inlet conveying roller pair 15 delivers the sheet S one by one sheet.

Numeral 73 is a pair of width alignment members of the upstream side provided movably on both side surfaces of the sheet placement table 71. The width alignment member 73 can be moved in the sheet width direction perpendicular to the sheet conveying direction, and at the time of the sheet receiving at which the sheet S is conveyed onto the sheet placement table 71, it is opened more widely than the sheet width. The sheet S is conveyed on the sheet placement table 71, and when the sheet S is brought into contact with the first contact member 72 and stopped, the width alignment member 73 taps the side edge in the width direction of the sheet S and conducts the width alignment (the width adjustment) of the sheet bundle Sa. In this stop position, when a predetermined number of the sheets S are stacked and adjusted on the sheet placement table 71, the staple processing is conducted by the staple means composed of a staple-pin striking mechanism 701 and staple-pin receiving mechanism 702, and the sheet bundle Sa is stapled.

In a portion of the sheet placement surface of the sheet placement table 71, a cutout portion is formed, and a delivery belt 75 trained around the drive pulley 74A and driven pulley 74B is rotatably driven. In a portion of the delivery belt 75, a delivery claw 76 is integrally formed, and its leading edge portion draws a locus X of an ellipse as shown by one-dotted chain line in the drawing. The trailing edge of the sheet S of the staple processed sheet bundle Sa is held by the delivery claw 76 of the delivery belt 75, placed on the delivery belt 75, and slides on the placement surface of the sheet placement table 71 and is pushed oblique-upwardly and advances to the holding position of the delivery roller 61 (refer to FIG. 2) of the sheet delivery means 60. The sheet bundle Sa held by the rotating delivery roller 61 is delivered and stacked onto the elevation sheet delivery table 91 (refer to FIG. 2).

The sheet placement table 71 on which the sheet bundle Sa is placed, staple processing section 70, and folding section 80 are arranged on a frame of the finishing unit 10, and can be pulled out on the front surface side of the finisher FS by being guided by slide rails R1 and R2.

Figure 4:
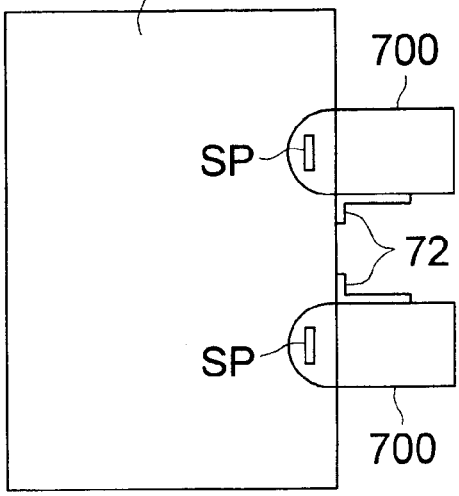
FIGS. 4(*a*)–4(*c*) are plan views showing an arrangement of a stapling means and a sheet bundle when each kind of stapling is conducted.
Figure 4:
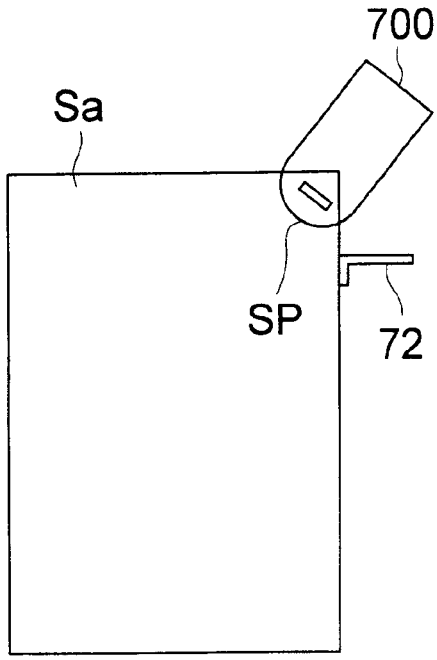
Figure 4:
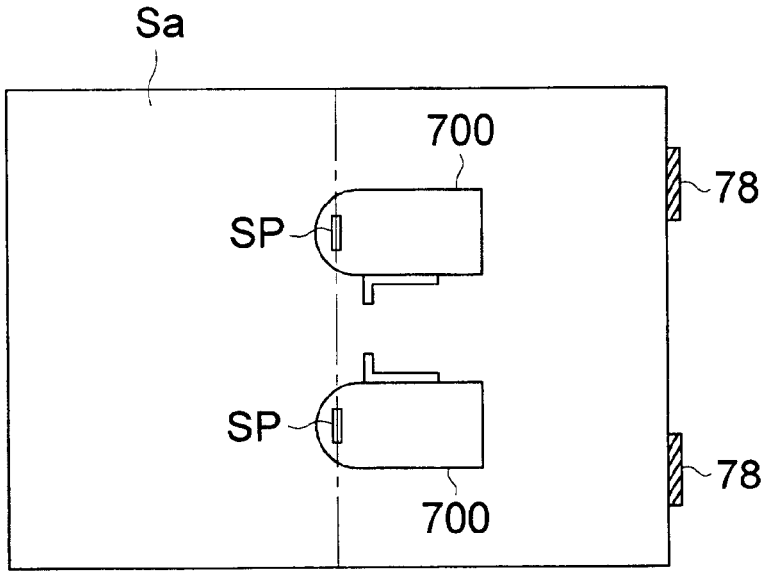

FIGS. 4(*a*)–4(*c*) are plan views showing the arrangement of the staple means 700 composed of the staple-pin striking mechanism 701 and staple-pin receiving mechanism 702, and the sheet bundle Sa, when each kind of stapling is conducted. FIG. 4(*a*) is a plan view showing the flat staple processing by which, in the vicinity of a side edge of the sheet bundle Sa, the staple pins SP are stapled at two portions distributed at the center, FIG. 4(*b*) is a plan view showing the edge staple processing by which, in one portion near the corner portion of the sheet bundle Sa, the staple pin SP is stapled, and FIG. 4(*c*) is a plan view showing the center staple processing by which the staple pins SP are stapled at two portions of the central portion.

Center Staple Processing

The staple means 700 is structured into the two dividing structure of the staple-pin striking mechanism 701 and staple-pin receiving mechanism 702, and the sheet path 77A on which the sheet S can pass, is formed between them (refer to FIG. 3).

Two sets of the stapling means 700 are arranged in the sheet width direction perpendicular to the sheet conveying direction, and can be moved in the sheet width direction by the drive means which is not shown.

When the flat staple processing shown in FIG. 4(*a*) is set, by two sets of the stapling means 700, the staple pins SP are stapled at two center distributed portions in the sheet width direction of the sheet bundle Sa.

When the end staple processing shown in FIG. 4(*b*) is set, the stapling means 700 straightly advanced in the sheet width direction, and the staple pins SP are struck at one portion of the corner portion of the sheet bundle Sa corresponding to the sheet size. When the center-stapling and the center-fold processing shown in FIG. 4(*c*) is set, the staple pins SP are struck at two central portions of the sheet bundle Sa.

When the stapling is set to the center staple processing, the first contact member 72 in the vicinity of the staple processing position (the staple-pin striking position) of the stapling means 700 is withdrawn from the conveying path, and almost simultaneously, the second contact member 78 for the combined use of the center stapling and center-fold processing positioned downstream it, is moved in the extension surface direction of the sheet path 77A, and shuts off the sheet path 77B.

The center stapling stopper unit having the second contact member 78, when the size of the cover sheet K2 and sheet S (length in the conveying direction) is set or detected, is moved to a position contacted with the lower edge portion of the sheet bundle Sa which is to be center-staple processed, and stopped.

After the cover sheet K2 is placed at a predetermined stop position on the sheet placement table 71, the sheet S conveyed from the image forming apparatus main body A passes the third conveying path (3) from the receiving section 11 of the finisher FS and successively stacked on the upper surface of the cover sheet K2 placed on the sheet placement table 71, and the leading edge portion of the sheet S is brought into contact with the second contact member 78, and positioned.

After the final sheet S is positioned and placed on the sheet placement table 71, the sheet bundle Sa formed of the cover sheet K2 and all of the sheets S is center-staple processed by the stapling means 700. By this center-staple processing, the staple pins SP is struck at the central portion in the conveying direction of the cover sheet K2 and sheets S. The staple pins SP are struck from the staple-pin striking mechanism 701 of the staple pin drive side toward the staple-pin receiving mechanism 702 of the staple-pin clinch side.

Fold Processing

Figure 5:
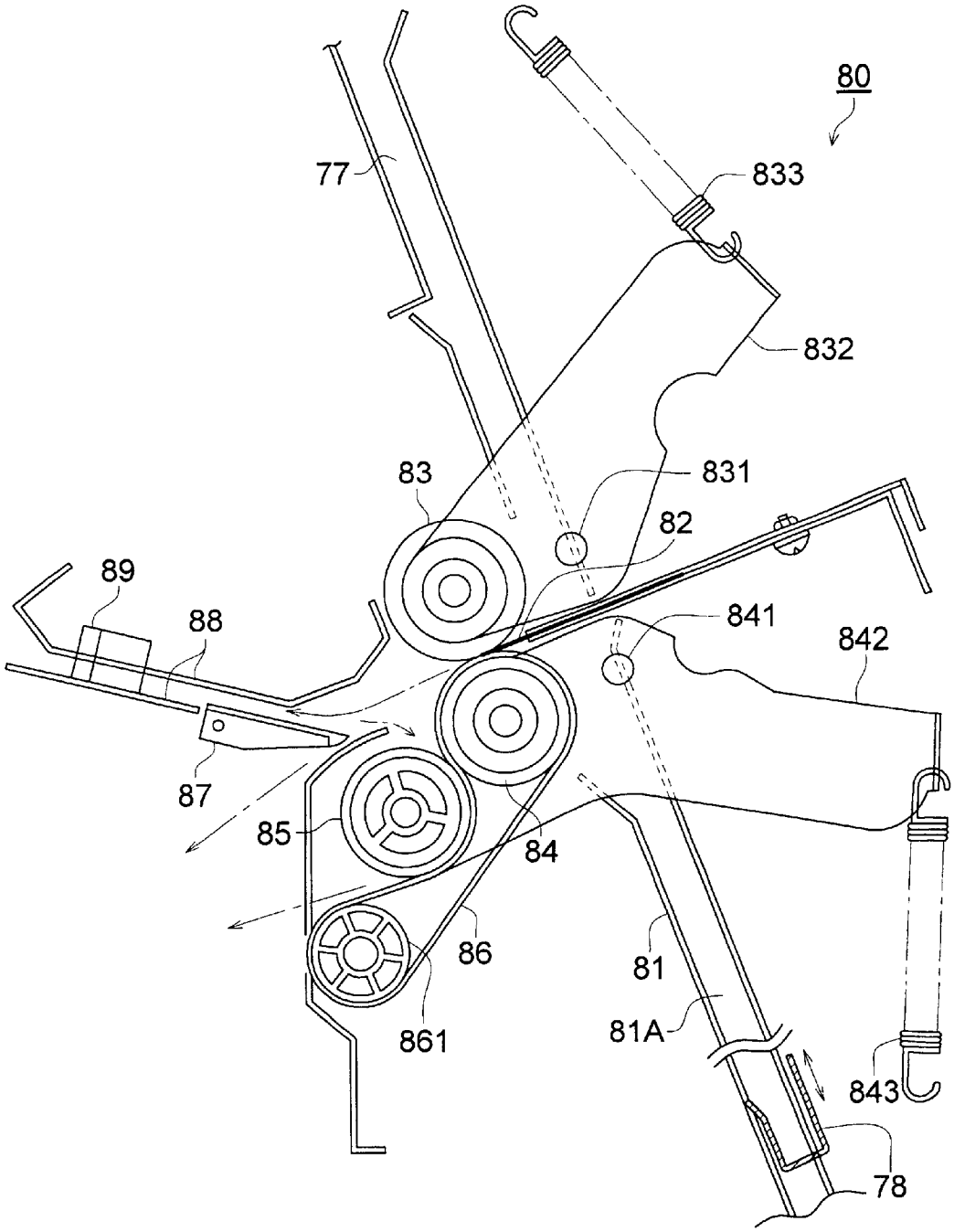
FIG. 5 is a front view of a fold processing section.
Figure 6:
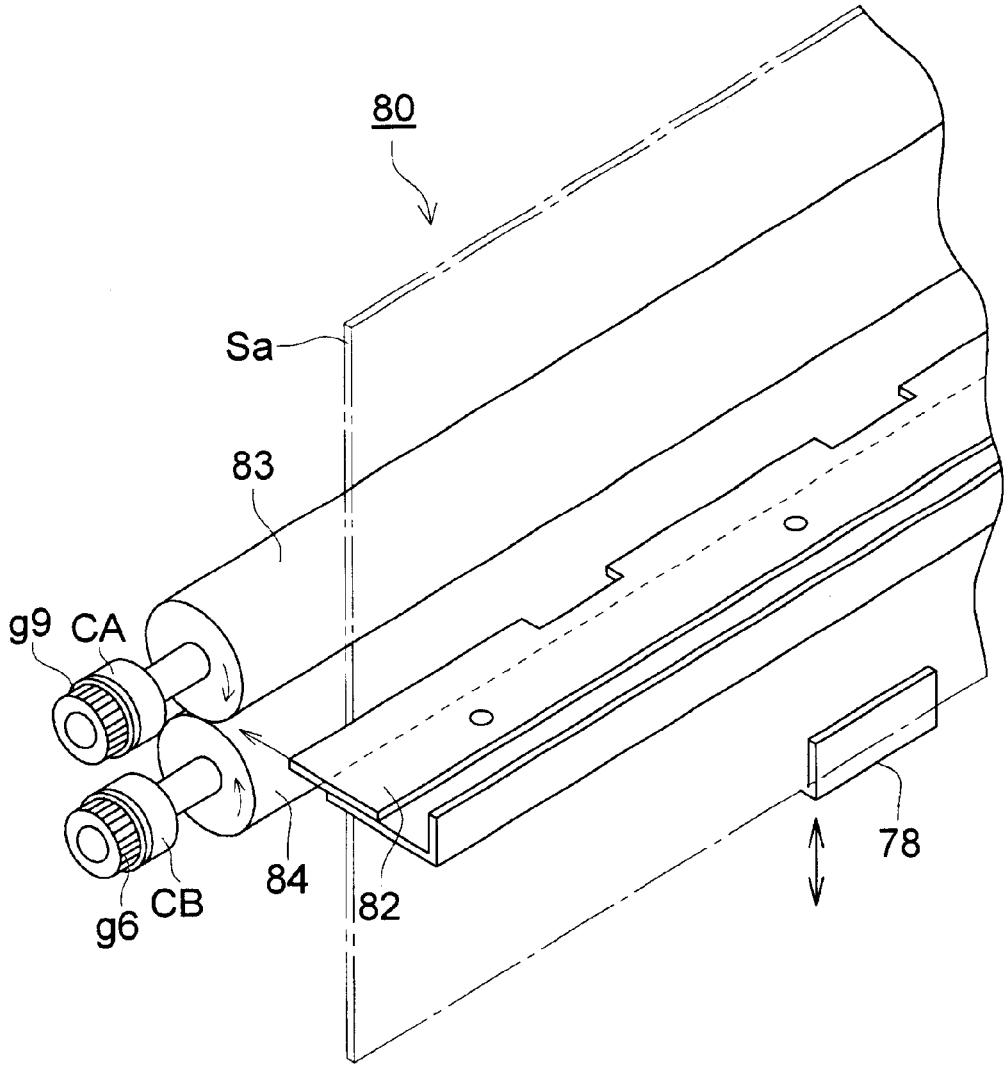
FIG. 6 is a perspective view of the fold processing section.

FIG. 5 is a front view of the fold processing section 80, and FIG. 6 is a perspective view of the fold processing section 80.

The fold processing section 80 is arranged at the obliquely lower portion of the staple processing section 70. After the center-staple processing, the second contact member 78 is linearly moved toward the conveying downstream direction of the sheet bundle Sa, and opens the path of the downstream of the sheet path 77A. The movable second contact member 78 regulates the stop position of the sheet bundle Sa at the time of the center staple processing at the upper position, and regulates the stop position of the sheet bundle Sa at the time of the center fold processing at the lower position.

The center staple processed sheet bundle Sa formed of the cover sheet K2 and sheet Sa is conveyed in the sheet path 81A whose oblique lower portion is formed of the guiding plate 81, and the edge portion in the conveying direction of the sheet bundle Sa is brought into contact with the second contact member 78, and stops at the predetermined position. The second contact member 78 can be moved to the predetermined position by the setting of the sheet size or detection result and the drive means.

The sheet placement table 71 of the finishing unit 10, sheet paths 77A, 77B, and 81A are formed on the almost same plane, and form a steep slope of about 70°.

The fold processing section 80 is composed of the folding plate 82, the first folding upper roller (hereinafter, called upper roller) 83, the first folding lower roller (hereinafter, called lower roller) 84, the second folding roller (hereinafter, called second roller) 85, conveying belt 86, tension roller 861, conveying path switching member 87, guiding plate 88, and sheet leading edge stop member 89, and the sheet bundle Sb is two-fold processed or three-fold processed.

The upper roller 83 and lower roller 84 are supported by one pair of left and right pressing means which form almost symmetrical forms. One side pressing means is composed of the upper roller 83, support plate 832 which rotatably supports this upper roller, and can oscillate around the support axis 831, and spring 833 which is engaged at one end of this support plate 832 and which urges the upper roller 83 toward the nip position direction. The lower roller 84 forms almost the symmetrical form with the upper roller 83, and is composed of the support axis 841, support plate 842, and spring 843. The upper roller 83 and the lower roller 84 are rotated by the first drive means 801 which will be described later.

Each outer peripheral surface of the upper roller 83 and lower roller 84 is formed of a high frictional resistant material.

Drive Mechanism of the Fold Processing Section

Figure 7:
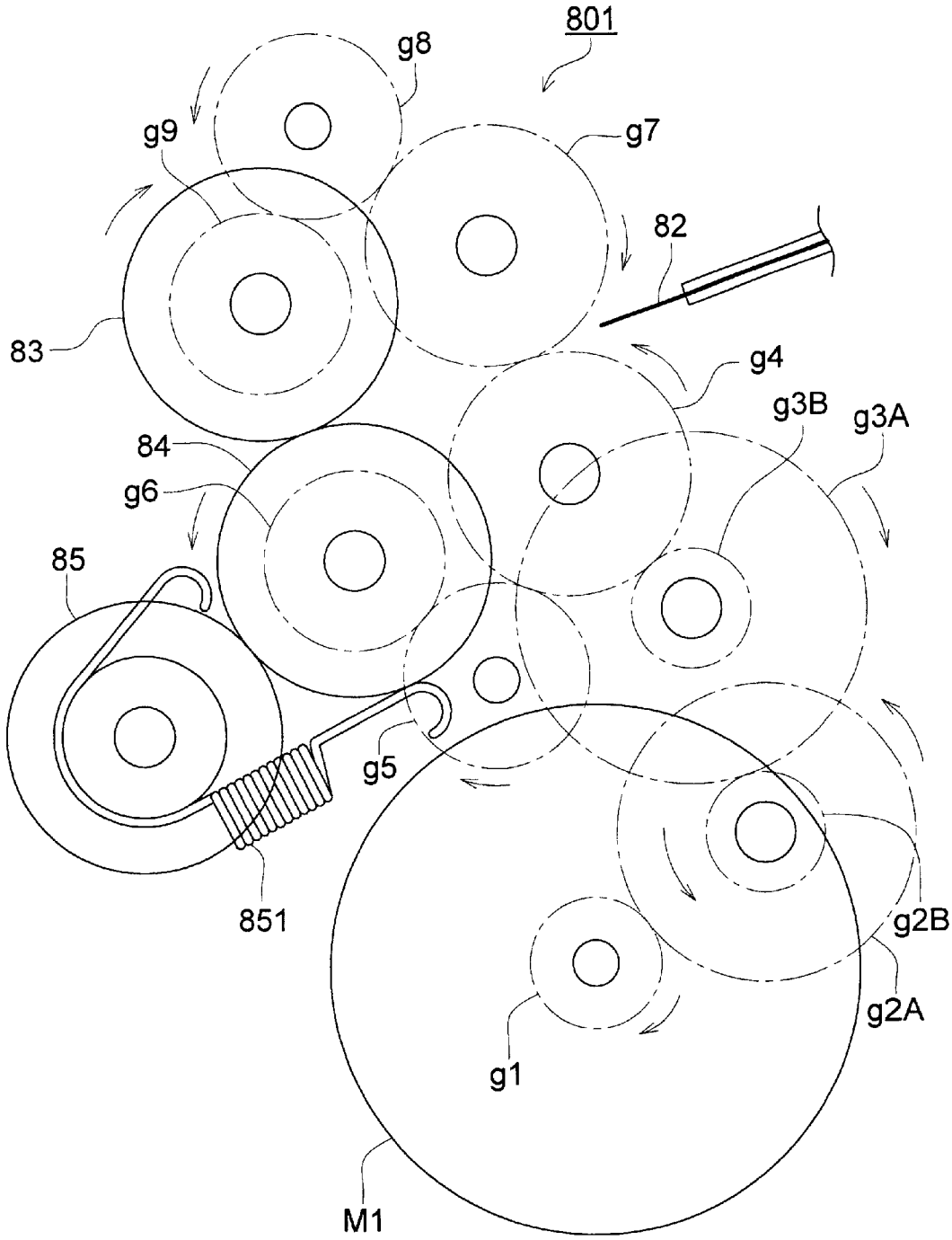
FIG. 7 is a structural view of a folding roller drive means.

FIG. 7 is a structural view of the upper roller 83, lower roller 84, and folding roller drive means (first drive means) 801 to rotate the second roller 85, of the fold processing section 80. In this connection, the one-doted chain line shown in the drawing shows a pitch circle of a gear.

A motor M1 drives the lower roller 84 through a gear train composed of gears g1, g2A, g2B, g3A, g3B, g4, g5, and g6. Further, the motor M1 drives the upper roller 83 through a gear train composed of gears g1, g2A, g2B, g3A, g3B, g4, g7, g8, and g9.

The second roller 85 is brought into pressure-contact with the lower roller 84 by the spring 851, and driven.

Drive Mechanism of the Folding Plate

Figure 8:
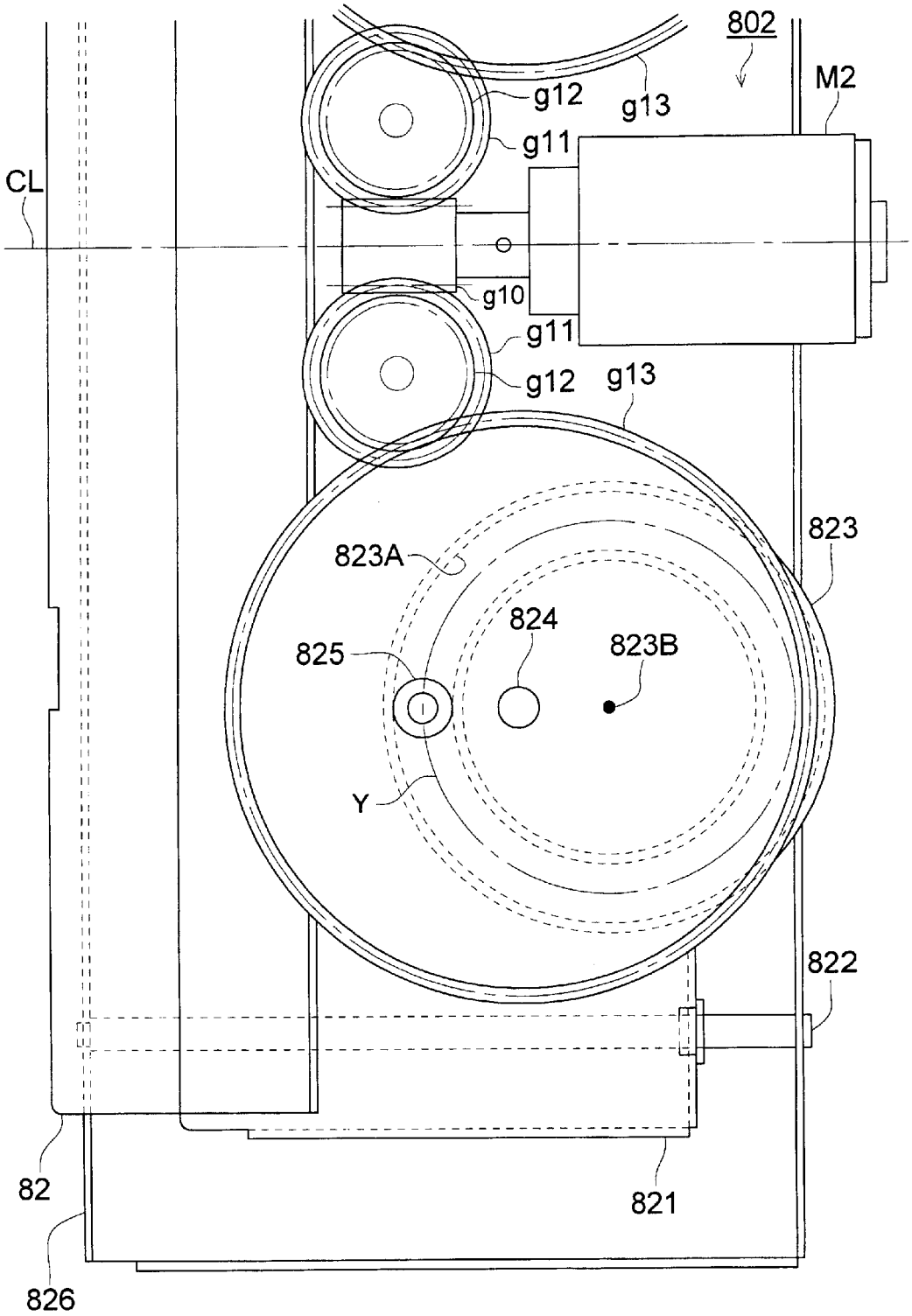
FIG. 8 is a plan view of a folding plate drive means.

FIG. 8 is a plan view of a folding plate drive means (second drive means) 802 to move the folding plate 82. In this connection, because the folding plate drive means 802 forms the line symmetry to the center line CL in the drawing, a portion of the drawing is neglected. In this connection, the drive members forming the symmetry are denoted by the same reference numerals.

Figure 9:
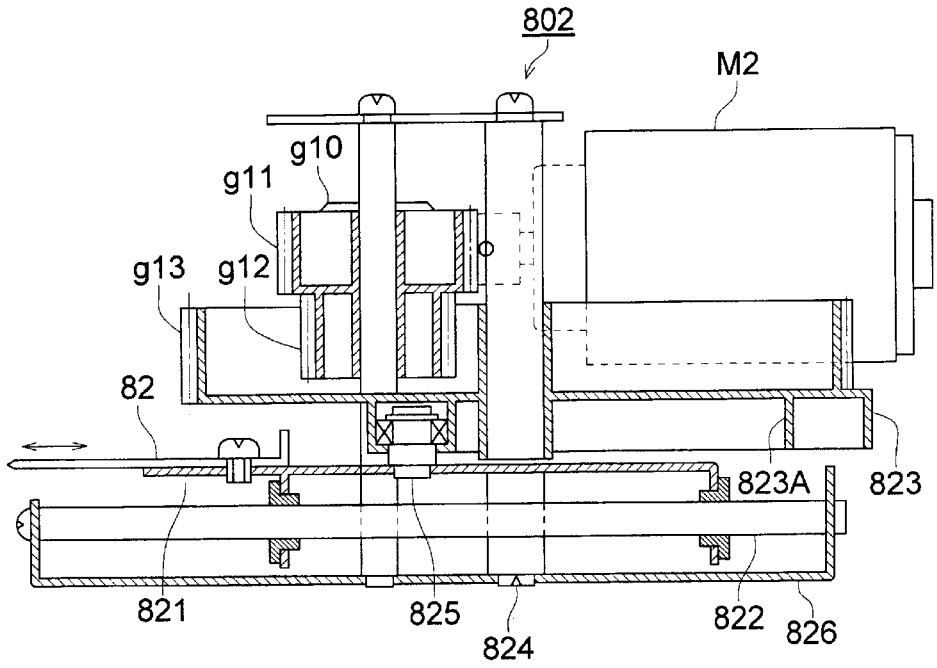
FIG. 9 is a sectional view of the folding plate drive means.

FIG. 9 is a sectional view of the folding plate drive means (second drive mean) 802. Both of FIG. 8 ands FIG. 9 show a condition just before the sheet bundle Sa is center-fold processed.

A motor M2 rotates a large diameter gear g13 through gears g10, g11 and g12. The gear g13 is rotatably supported by the support axis 824 planted on the fixed base plate 826. On the base portion of the gear g13, an eccentric cylinder member 823 is integrally formed. A ring-like concave portion 823A provided in the eccentric cylinder member 823 is, by the rotation of the gear g13, eccentrically moved around an eccentric axis 823B whose rotation center is different from that of the support axis 824.

On an inner wall portion of the ring-like concave portion 823A, a roller 825 planted on the moveable holding member 821 is movably provided. A sign Y is an eccentric circle locus of the center of the roller 825.

The movable holding member 821 is supported in such a manner that it can conduct the straight advance reciprocal movement along two guiding members 822 parallely arranged on the fixed base plate 826. By the rotation of the gear g13, when the ring-like concave portion 823A is eccentrically moved, the roller 825 is moved along the inner wall of the ring-like concave portion 823A and the movable holding member 821 conducts the straight advance reciprocal movement along the two guiding members 822. The folding plate 82 fixed on the movable holding member 821 also conducts simultaneously the straight advance reciprocal movement.

Center-fold Processing of the Sheet

FIGS. 10(*a*)–10(*c*) are sectional views showing processes of two-fold processing by the fold processing section 80, and FIG. 10(*a*) shows a condition that the folding plate 82 presses the sheet bundle Sa and makes it bring into contact-pressure with the upper roller 83 and lower roller 84. FIG. 10(*b*) shows a condition that the folding plate 82 enters a position beyond the nip position N between the upper roller 83 and lower roller 84 and the sheet bundle Sa is two-fold processed. FIG. 10(*c*) shows a condition that the folding plate 82 is withdrawn from the nip position N between the upper roller 83 and lower roller 84 and returns to the initial position, and the two-fold processed sheet bundle Sa is delivered from the upper roller 83 and lower roller 84.

By a two-fold processing start signal, the folding plate 82 connected to the drive source projects in the left direction in the drawing from the sheet placement surface. The folding plate 82 forms a 0.3 mm thick thin-type knife shape in the present embodiment, and its leading edge portion forms a sharp angle.

The leading edge portion of the folding plate 82 which is straightly advanced in the left direction in the drawing and is projected, pushes the central portion of the sheet bundle Sa, and widens the nip position N between the upper roller 83 and lower roller 84 through the sheet bundle Sa and separates them from each other.

After the leading edge portion of the folding plate 82 passes the nip position N between the upper roller 83 and lower roller 84, the folding plate 82 is retreated and the central portion of the sheet bundle Sa is narrowed and pressed by the upper roller 83 and lower roller 84, and a fold portion "c" is formed. This fold portion "c" almost coincides with the stapling position of the staple pin SP onto the sheet bundle Sa by the center-staple processing.

The sheet bundle Sa on which the fold portion "c" is formed by being narrow-pressed, is conveyed by the rotating upper roller 83 and lower roller 84, and placed on the fixed sheet delivery table 92 outside the apparatus.

Figure 11:
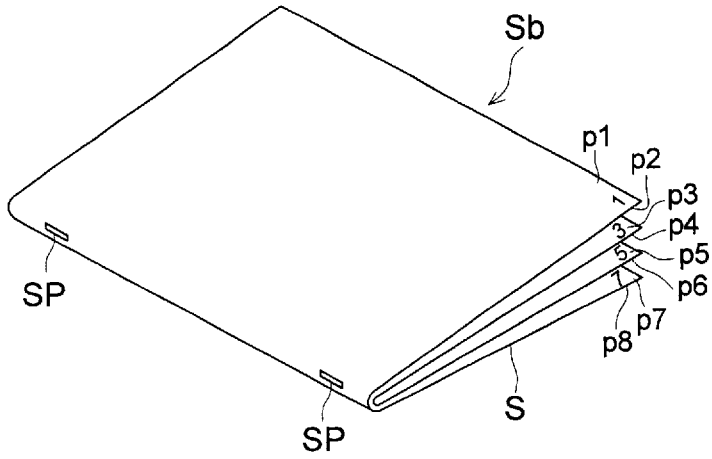
FIGS. 11(*a*)–11(*c*) are a perspective view of a sheet bundle on which the finishing of a center-stapling and two-folding is conducted (FIG. 11(*a*)), a perspective view of the sheet bundle in the double-opened condition (FIG. 11(*b*)), and a typical sectional view of the sheet bundle (FIG. 11(*c*)).
Figure 11:
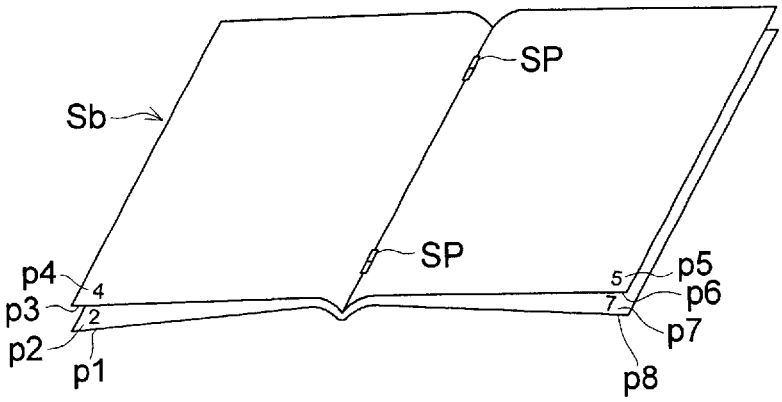
Figure 11:
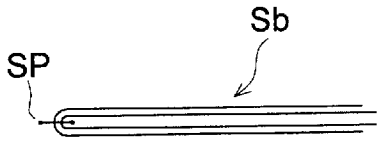

FIG. 11(*a*) is a perspective view of the sheet bundle Sb on which the finishing of the center-stapling and two-folding is conducted, FIG. 11(*b*) is a perspective view showing a condition in which the finished sheet bundle Sb is opened into two-leaves, and FIG. 11(*c*) is typical sectional view of the sheet bundle Sb.

In the sheet bundle Sb made by the center-staple processing and two-fold processing, the first surface (p1, p8) of the cover sheet K2 faces outward, and on its rear surface side, the second surface (p2, p7) is arranged, and further, in its inner side, the first surface (p3, p6) of the sheet S which is the content, is arranged, and in its inner side, the second surface (p4, p5) of the sheet S is arranged, and as shown in the drawing, a booklet Sb formed of 8 pages (p1–p8) can be collated.

Three-fold Processing

The fold processing section 80 shown in FIG. 5 can conduct two modes of the two-fold processing and three-fold processing. The fold processing section 80 has the first folding means by which the sheet bundle Sa is two-fold processed, and the second folding means by which the sheet bundle Sa is three-fold processed.

The first folding means is composed of the upper roller 83, lower roller 84, and folding plate 82. The second folding means is composed of the second roller 85, conveying belt 86, conveying path switching member 87, guiding plate 88, and sheet leading edge stop member 89.

The position of the sheet leading edge stop member 89 is set so that the sheet conveying distance from the nip position N (refer to FIGS. 10(*a*)–10(*c*)) between the upper roller 83 and lower roller 84, to the sheet contact surface of the sheet leading edge stop member 89 is ⅓ of the conveying direction length of the sheet S.

The lower roller 84 and the second roller 85 are rotatably supported by the support plate 842, and connected to the first drive means 801 (refer to FIG. 7). The conveying belt 86 is trained around the outer peripheral surface of the lower roller 84 and second roller 85, and tension roller 861.

FIG. 12(*a*) is a developed plan view of the sheet S to be three-fold processed, and FIG. 12(*b*) is a perspective view of the three-fold processed sheet S. Folds "a", "b" by which the length of the longitudinal direction of the sheet S is divided into about three equal parts, fold the sheet S into the surface A, surface B, and surface C. The sheet S to be tree-fold processed, is initially folded by a fold "a", and next, folded by the fold "b" to the inside.

FIG. 12(*c*) is a perspective view of the sheet S which is three-fold processed into a Z-letter shape. The sheet S to be three-fold processed is initially folded by the fold "b", and next, folded by the fold "a" to the outside.

In this connection, the three-fold processing can fold simultaneously a small number of sheets, for example, about three sheets S. The sheet S which is three-fold processed is folded into a small size, and can be accommodated in the envelope of the ordinary mail.

FIGS. 13(*a*)–13(*d*) are sectional views showing the three-fold processing process. In this connection, in this three-fold processing process, the inner side folding shown in FIG. 12(*b*) is formed. When the three-fold processing is conducted into the Z-letter shape, the arrangement position of the second contact member 78 is changed, and the fold portion "b" is folded by the upper roller 83 and lower roller 84.

(1) In FIG. 13(*a*), the leading edge portion of the folding plate 82 presses the position of the fold "a" formed on the sheet S and inserts it into the nip position N (refer to FIGS. 10(*a*)–10(*c*)) between the upper roller 83 and lower roller 84. The upper roller 83 and lower roller 84 is rotated in the solid line arrowed direction, and while forming the fold portion "a" of the sheet S, the sheet S is nipped. After the fold portion "a" is formed by the upper roller 83 and lower roller 84, the folding plate 82 is withdrawn from the nip position N, and returns to initial position.

(2) As shown in FIG. 13(*b*), the sheet S whose fold "a" is formed between the upper roller 83 and lower roller 84, is conveyed in the solid line arrowed direction by the rotating upper roller 83 and lower roller 84, advances along the upper surface of the conveying path switching member 87, and the fold portion "a" of the sheet S is brought into contact with the sheet leading edge stop member 89.

(3) As shown in FIG. 13(*c*), when the upper roller 83 and lower roller 84 are successively rotated, although the fold portion "a" of the sheet S is brought into contact with the sheet leading edge stop member 89 and its advance is blocked, a ⅓ portion of the length of the trailing edge of the sheet S is wound around the outer peripheral surface of the lower roller 84 whose frictional resistance is large, and conveyed to the nip position at which the lower roller 84 and the second roller 85 are pressure-contacted, and the fold portion "b" is formed on the sheet S.

(4) As shown in FIG. 13(*b*), the fold portion "a" and fold portion "b" are formed at the nip position between the lower roller 84 and the second roller 85, and the leading edge portion and trailing edge portion are folded back and the three-fold processed sheet S is nipped by the lower roller 84, second roller 85, tension roller 861 and conveying belt 86, and conveyed, and placed on the fixed sheet delivery table 92 outside the apparatus.

Control Means of the Finisher

Figure 14:
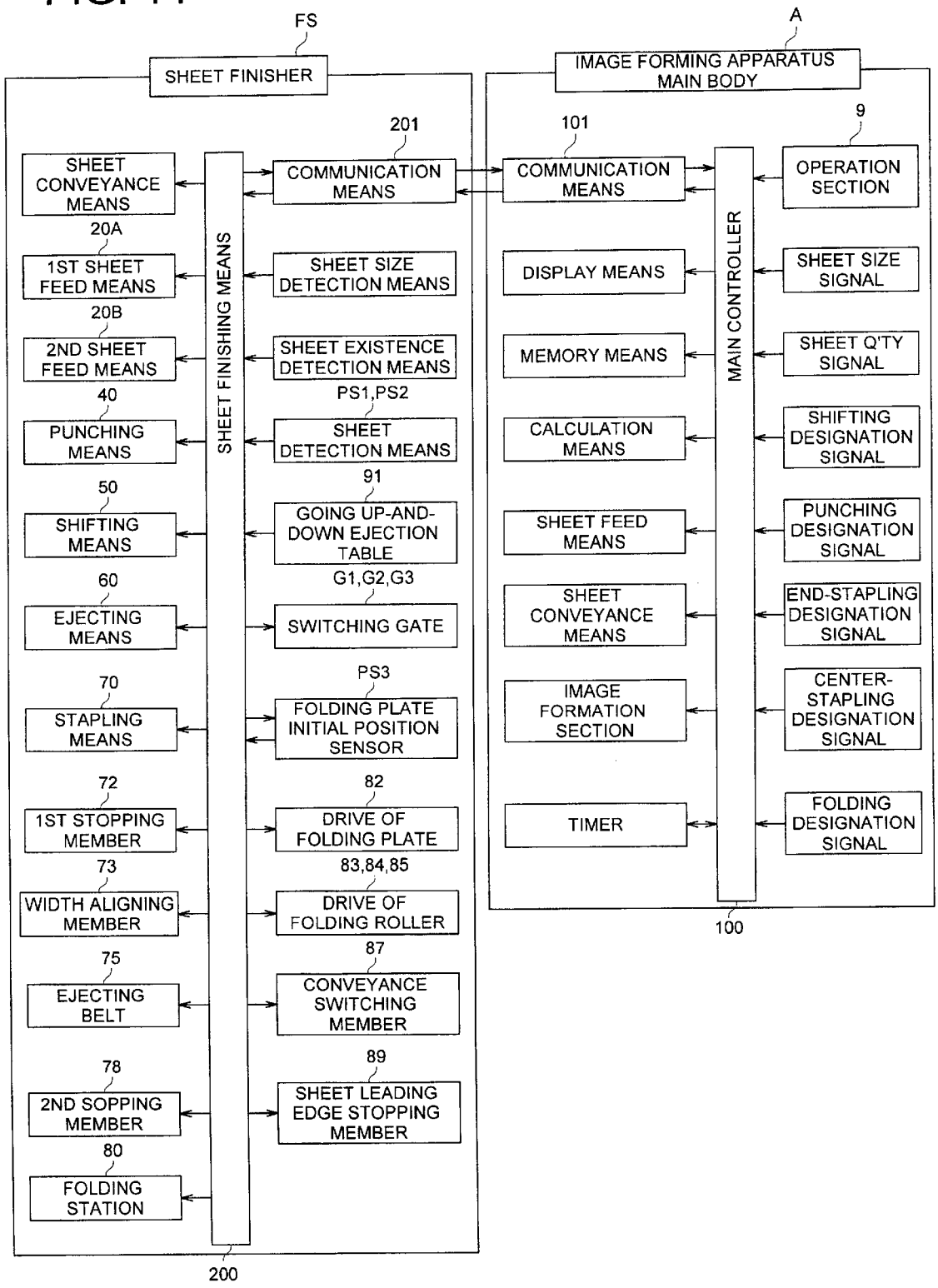
FIG. 14 is a block diagram showing the control of an image forming apparatus main body and finisher.

FIG. 14 is a block diagram showing the control of the image forming apparatus main body A and finisher FS.

A communication means 101 of a main control means 100 of the image forming apparatus main body A and a communication means 201 of a finishing control means 200 of the finisher Fs are electrically connected, and the sending and receiving of the control signal is mutually conducted.

By the selection means of the operation section 9, the sheet feeding by the first sheet feed means 20A and the second sheet feed means 20B of the finisher FS, punch processing by the punching means 40, shift processing by the shift means 50, each processing of the end stapling and center-stapling by the staple processing section 70, and each of the center-fold processing and three-folding, are set.

By this setting, the main control means 100 sends the control signal to the finisher FS through the communication means 101. The control signal is transmitted to the finishing control means 200 through the communication means 201. The finishing control means 200 drives the set each means.

The sheet conveying control in the fold processing section 80 will be described below.

Fold Processing of a Small Number of Sheets

Figure 15:
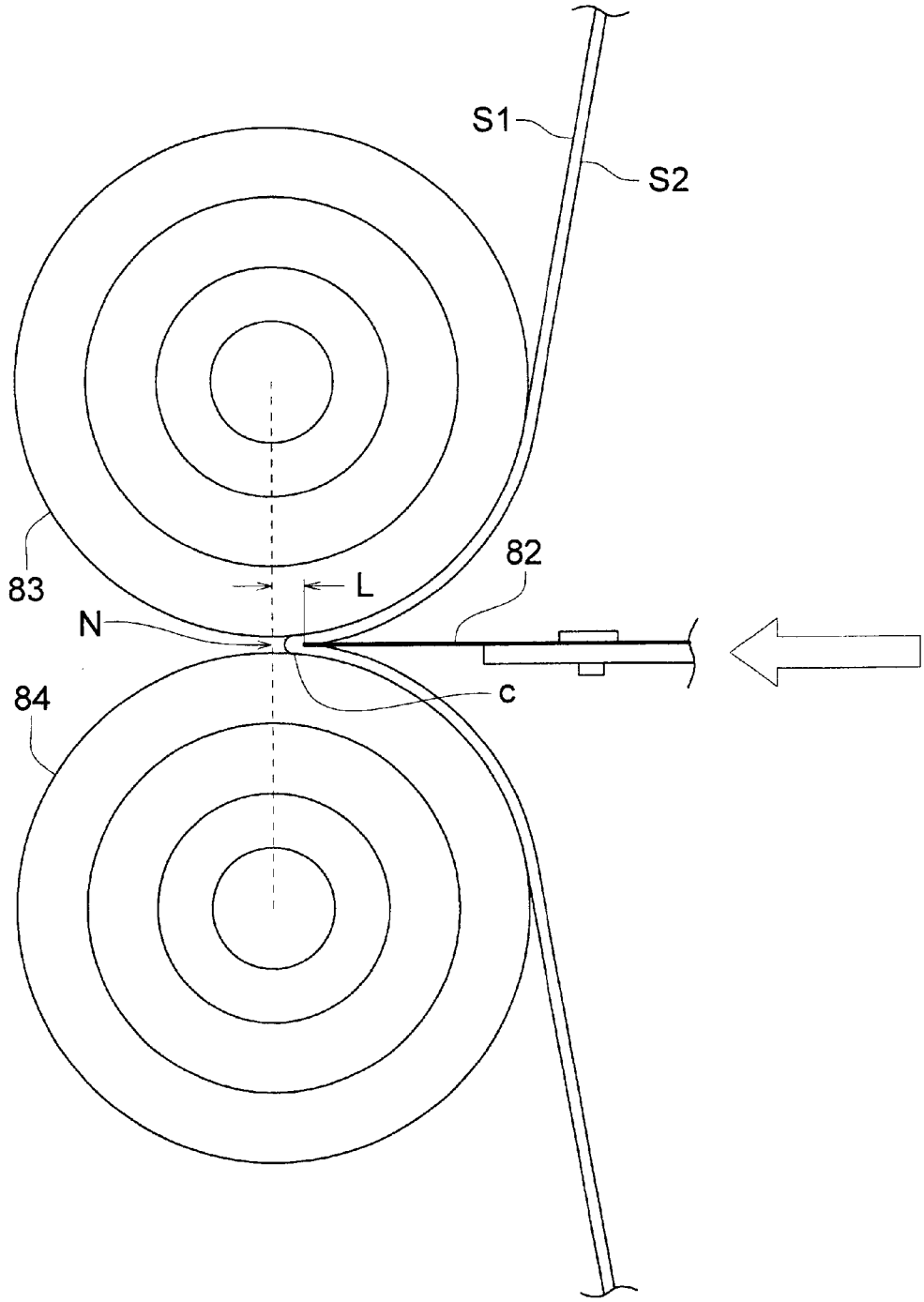
FIG. 15 is an enlarged sectional view showing a fold processing of a small number of sheets by a folding plate, upper roller, and lower roller.

FIG. 15 is an enlarged sectional view showing the fold processing of a small number of sheets by the folding plate 82, upper roller 83, and lower roller 84.

When any one of the center-fold processing, three-fold processing, or Z-fold processing is conducted on the sheets S of a small number of sheets (1–3 sheets) on which center-staple processing is not conducted, initially, the drive of the motor Ml of the first drive means 801 shown in FIG. 7 is stopped, and the rotation of the upper roller 83 and lower roller 84 is maintained to the stop condition. In this condition, the drive of the motor M2 of the second drive means 802 shown in FIG. 8 and FIG. 9 is started, and the folding plate 82 is advanced from the stand-by position to the hollow arrowed direction shown in the drawing.

The leading edge portion of the folding plate 82 projects the fold "a" of the small number of sheets (sheets S1, S2 in the drawing), and while making the sheet surface sliding contact with the outer peripheral surface of the upper roller 83 and lower roller 84, pushes it into the vicinity of the nip position N, and simultaneously folds the sheets S1 and S2 and forms the fold "c".

When the leading edge portion of the folding plate 82 projects the fold portion "c" of the sheets S1 and S2, and making it sliding contact with the outer peripheral surface of the upper roller 83 and lower roller 84 and sends it to the vicinity of the nip position N, by one way rotation clutches CA and CB provided on each of axis ends of the upper roller 83 and lower roller 84, the upper roller 83 and lower roller 84 sliding contact with the moving sheets S1 and S2, and are driven only in the sheet conveying direction (refer to FIG. 6).

When an initial position sensor (not shown) of the second drive means 802 and a timer clocking (or step clocking) detect that the leading edge portion of the folding plate 82 reaches a predetermined distance L on this side of the nip position N, the drive of the motor M2 is stopped, and the folding plate 82 is temporarily stopped at a predetermined position. The predetermined distance L between the folding plate 82 leading edge portion and nip position N at the time of temporary stop of the folding plate 82, is 1–2 mm.

When it is detected that the leading edge portion of the folding plate 82 reaches the predetermined distance L on this side of the nip position N, the finishing control means 200 starts the drive of the motor M1. By the drive start of the motor M1, the rotation of the upper roller 83 and lower roller 84 is started.

At almost the same time, by the reversal drive of the motor M2, the folding plate 82 starts the withdrawal, and the leading edge portion of the folding plate 82 is pulled from the fold portion "c" of the sheets S1 and S2, and the fold portion "c" of the sheets S1 and S2 is nipped and held on the outer peripheral surface of the upper roller 83 and lower roller 84, and the fold portion "c" is strongly formed.

In this connection, the withdrawal start of the folding plate 82 may be conducted at the time of drive start of the motor M1, or after the path of a predetermined time period. When the leading edge portion of the folding plate 82 is pulled from the fold portion "c" of the sheets S1 and S2, because the upper roller 83 and lower roller 84 are prevented from reversing the rotation by the one way rotation clutches CA and CB, the sheets S1 and S2 are not withdrawn.

As described above, in the case where the number of sheets to be fold processed is small (1–5 sheets), when the sheets S are pushed into the vicinity of the nip position N between the upper roller 83 and lower roller 84 whose rotation is stopped, by the folding plate 82, and the fold portion "c" is formed on the sheet S, the slippage between the sheets is dissolved.

Further, because the leading edge portion of the folding plate 82 is not pushed into the position beyond the nip position N between the rotating upper roller 83 and lower roller 84, when the folding plate 82 is inserted into the nip position N, the drive torque of the second drive means 802 can be reduced.

When the center-fold processing is conducted on the volume of the small number (2–5 sheets) of sheets S on which the center-staple processing is conducted, the slippage between the sheets at the time of folding processing of the sheet bundle on which the center-staple processing is conducted, is smaller than the sheet bundle on which the center-staple processing is not conducted. However, because the sheet slippage other than the stapling section is generated, the above fold processing control is applied on the small number (2–5 sheets) of sheets S.

Fold Processing of a Large Number of Sheets

When the center-fold processing is conducted on the bundle of many number (6–20) of sheets S on which the center-staple processing is conducted, it is difficult that the thick sheet bundle is pushed into the vicinity of the nip position N between the upper roller 83 and lower roller 84 whose rotation is stopped, as the above folding control of the small number of sheets. On the volume of many number of sheets S which is center-staple processed, the folding plate 82 is advanced, pushed, and it is pushed into the vicinity of the nip position N between the rotating upper roller 83 and lower roller 84, and the fold portion "c" is formed and the booklet is made.

Each mode switching of the fold processing of the small number of sheets S, or the fold processing of the many number of sheets S is conducted by the number of sheets signal of the image forming apparatus main body A and the sheet path detection means of the finisher FS.

Control of the Fold Processing

Figure 16:
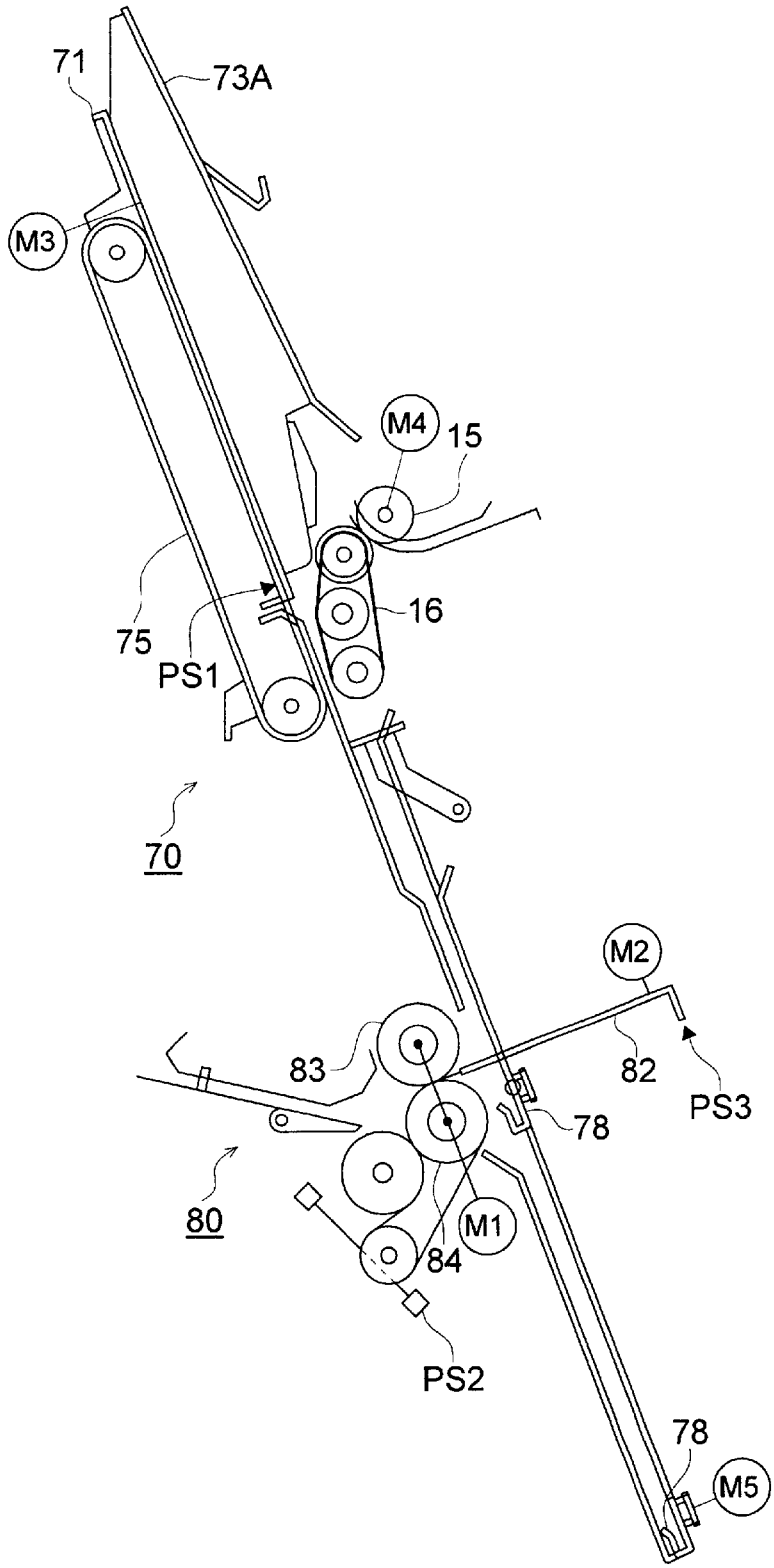
FIG. 16 is a typical view showing the arrangement of a motor and sensor in a stapling section and fold processing section.
Figure 18:
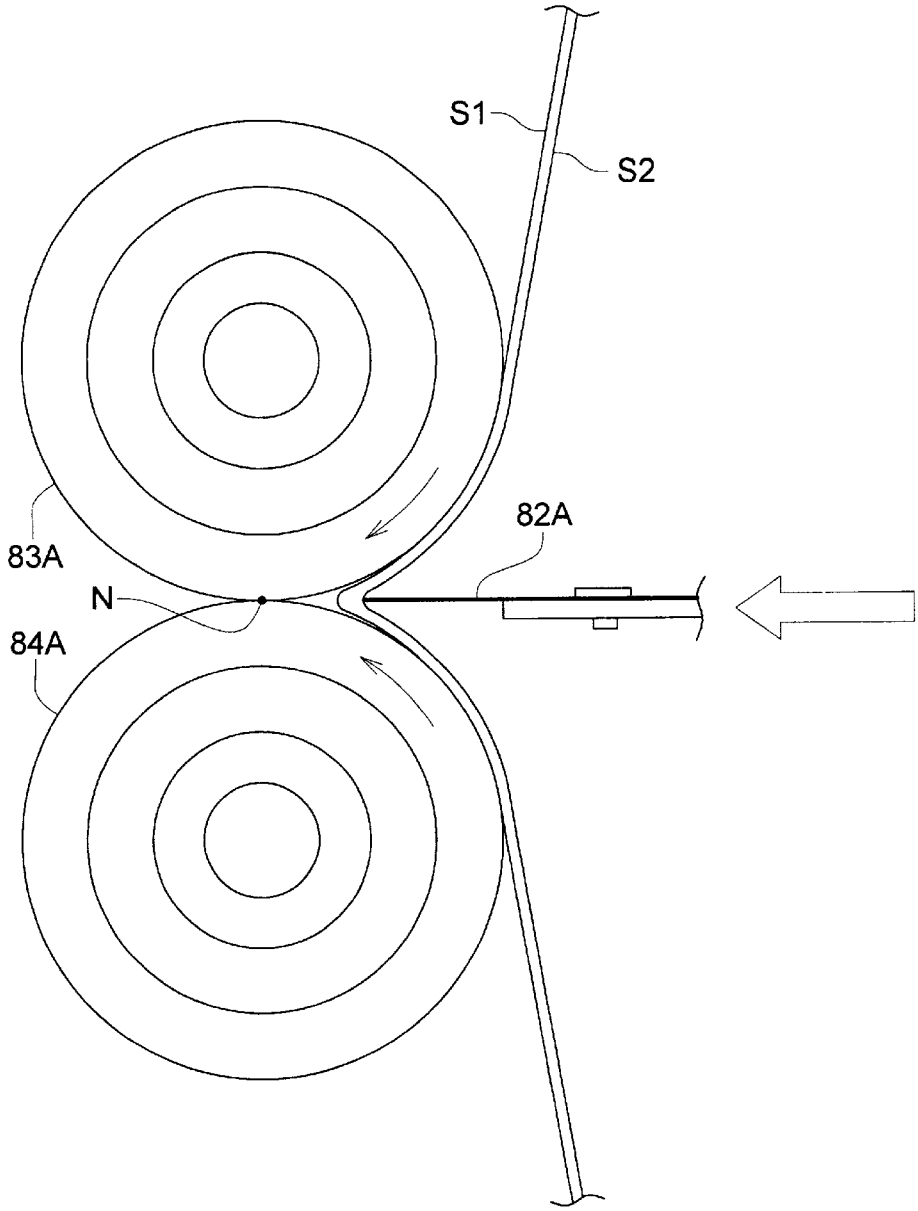
FIG. 18 PRIOR ART
FIG. 18 is a sectional view of the conventional center-fold processing section.

FIG. 16 is a typical view showing the arrangement of the motor and sensor in the staple processing section 70, and fold processing section 80. FIGS. 17(*a*)–17(*f*) are timing charts showing the control of the fold processing.

When, on the sheet placement table 71 shown in FIG. 2, the final sheet S reaches and is brought into contact with the second contact member 78, the motor M3 is driven and the width alignment member 73 pressed the side edge in the width direction of the sheet bundle and the width is aligned (final alignment (FIG. 17(*a*)). When the final alignment is completed, the drive of the motor M4 is stopped, and the rotation of the inlet conveying roller pair 15 and the winding-in belt 16 is stopped (FIG. 17(*b*)).

After the drive stop of the motor M4, the drive of the motor MS is started, the second contact member 78 is moved from the stop position at the time of the center-staple processing to the stop position at the time of the center-fold processing (FIG. 17(*c*)).

By an AND condition (FIG. 17(*i*)) of the drive stop signal of the motor MS and a signal detecting the path of the sheet S of the sheet path detection sensor PS1 arranged on the sheet placement table 71, the drive start of the motor Ml and the motor M2 is controlled.

When the center-fold processing is conducted on 6–20 sheets S which are center-staple processed, the drive of the motor M1 is started after the path of the predetermined time T1 by the timer clocking from the drive stop time of the motor MS, and the upper roller 83 and lower roller 84 are low speed rotated (FIG. 17(*d*)).

When the center-fold processing is conducted on 2–5 small number of sheets S which are center-staple processed, or the center-fold processing is conducted on 1–3 small number of sheets S which are not staple processed, the drive of the M1 is started from the detection signal generation of the sensor PS3 to detect the initial position of the folding plate 82, and the upper roller 83 and lower roller 84 are low speed rotated (FIG. 17(*e*)).

Under the AND condition, after the predetermined time T2 path by the timer clocking from the drive stop signal of the motor M5, the drive of the motor M2 is started (FIG. 17(*g*)), and the folding plate 82 is advanced to the vicinity of the nip position N. After the folding plate 82 is advanced by the normal drive of the motor M2 and cam mechanism, it is retreated and returns to the initial position (FIG. 17(*g*)).

When the center-fold processing is conducted on 6–20 sheets S which are center-staple processed, the folding plate 82 is made advance to the nip position N between the upper roller 83 and lower roller 84 which are rotating at the low speed, and is inserted into the position.

When the center-fold processing is conducted on 2–5 small number of sheets S which are center-staple processed, or the center-fold processing is conducted on 1–3 small number of sheets S which are not stapled, the folding plate 82 is made advance to the nip position N between the upper roller 83 and lower roller 84 which are in the stopped condition, and is inserted into the position.

When the initial position returning of the folding plate 82 is detected by the sensor PS3 (FIG. 17(*h*)), the drive of the motor M2 is stopped. At almost the same time, the motor M1 is switched from the low speed rotation (for example, 500 rpm) to the high speed rotation (for example, 2500 rpm) (FIGS. 17(*d*) and 17(*e*)), and the upper roller 83 and lower roller 84 are rotated at the high speed, and the sheet bundle on which the fold processing is completed, is delivered at the high speed.

After the predetermined time T3 by the timer clocking is passed from the time when the sensor PS2 arranged on the delivery side of the fold processing section 80 detects the trailing edge path of the sheet bundle on which fold processing is conducted (FIG. 17(*f*)), the drive of the motor M1 is stopped (FIG. 17(*c*)).

In this connection, in the embodiment of the present invention, the finisher connected to the copier main body is described, however, the present invention can also be applied to the finisher connected to the image forming apparatus main body such as the printer, facsimile device, or hybrid machine.

As clearly be seen from the above description, by the sheet finishing method, finisher and image forming apparatus of the present invention, the following effects can be attained.

(1) the small number of sheets are pushed in the nip position between the upper roller and lower roller by the folding plate, and when a fold portion is formed, the slippage between the sheets can be solved.

(2) when the folding plate is inserted into the nip position between the upper roller and lower roller and the small number of sheets are fold processed, the drive torque of the drive means can be reduced.

(3) In the finisher connected to the image forming apparatus main body such as the copier or printer, the desired digital processing is conducted by the image forming apparatus main body, and even the sheets which is high speed delivered generate a bend, after the fixing processing, by the finisher of the present invention, the sheet conveying is correctly conducted at high speed, the high productivity is maintained, and the finishing such as the fold processing is conducted at high speed.

What is claimed is:

1. A sheet finishing method comprising the steps of:

(a) stacking sheets delivered and conveyed from an image forming apparatus main body onto a sheet placement table;

(b) positioning and aligning the stacked sheets;

(c) folding the aligned sheets by a folding device composed of paired folding rollers and a folding plate; and (d) switching a rotation motion of the paired folding rollers between a first state wherein the paired folding rollers are rotated and the folding plate is advancing and a second state wherein the paired folding rollers are stopped and the folding plate is advancing, the switching between the first state and the second state, in accordance with the number of sheets stacked on the sheet placement table.

2. A sheet finisher comprising:

(a) a sheet placement table on which sheets delivered and conveyed from an image forming apparatus main body, are stacked;

(b) a folding device for folding the stacked sheets which have been positioned and aligned, a folding device comprising paired folding rollers and a folding plate;

(c) a detector for detecting the number of sheets stacked;

(d) a first driving device for rotating the paired folding rollers;

(e) a second driving device for making the folding plate to advance or retreat; and (f) a controller for controlling the first driving device and the second driving device, wherein the controller controls the first driving device and the second driving device such that a rotation motion of the paired folding rollers is switched between a first state wherein the paired folding rollers are rotated and the folding plate is advancing and a second state wherein the paired folding rollers are stopped and the folding plate is advancing, the switching between the first state and the second state, in accordance with the number of sheets stacked on the sheet placement table.

3. The sheet finisher of claim 2, wherein when the number of sheets that have not been stapled is 1 to 3 or the number of sheets that have been stapled is 2 to 5, the controller controls the first driving device and the second driving device such that the paired folding rollers are switched to the second state, and the folding plate is made to advance and a leading end thereof is inserted into an interposing position of the paired rollers, while when the number is sheets that have been stapled is 6 or more, the controller controls the first driving device such that the paired folding rollers are switched to the first state, and the leading end of the folding plate is inserted into the interposing position of the paired rollers which are being rotated.

4. An image forming apparatus comprising:

an image forming apparatus main body composed of an image writing station, and sheet conveying station; and a sheet finisher comprising:

(a) a sheet placement table on which sheets delivered and conveyed from an image forming apparatus main body, are stacked;

(b) a folding device for folding the stacked sheets which have been positioned and aligned, a folding device comprising paired folding rollers and a folding plate;

(c) a detector for detecting the number of sheets stacked;

(d) a first driving device for rotating the paired folding rollers;

(e) a second driving device for making the folding plate to advance or retreat; and (f) a controller for controlling the first driving device and the second driving device, wherein the controller controls the first driving device and the second driving device such that a rotation motion of the paired folding rollers is switched between a first state wherein the paired folding rollers are rotated and the folding plate is advancing and a second state wherein the paired folding rollers are stopped and the folding plate is advancing, the switching between the first state and the second state, in accordance with the number of sheets stacked on the sheet placement table.

* * * * *